US006169948B1

(12) United States Patent
Fujishima et al.

(10) Patent No.: US 6,169,948 B1
(45) **Date of Patent: *Jan. 2, 2001**

(54) FRONT CONTROL SYSTEM, AREA SETTING METHOD AND CONTROL PANEL FOR CONSTRUCTION MACHINE

(75) Inventors: Kazuo Fujishima, Ibaraki-ken; Hiroshi Watanabe, Ushiku; Masakazu Haga; Takashi Nakagawa, both of Ibaraki-ken, all of (JP)

(73) Assignee: Hitachi Construction Machinery Co., Ltd., Tokyo (JP)

( * ) Notice: Under 35 U.S.C. 154(b), the term of this patent shall be extended for 0 days.

This patent is subject to a terminal disclaimer.

(21) Appl. No.: 08/879,927

(22) Filed: Jun. 20, 1997

(30) Foreign Application Priority Data

Jun. 26, 1996 (JP) ..... 8-166377
Jun. 26, 1996 (JP) ..... 8-166424

(51) Int. Cl.[7] ..... E02F 3/00

(52) U.S. Cl. ..... 701/50; 37/348; 477/155; 172/4.5; 172/5; 340/500; 340/679; 340/684

(58) Field of Search ..... 701/50; 340/679, 340/684, 500; 37/348; 477/155; 172/4.5, 5, 132, 234

(56) References Cited

U.S. PATENT DOCUMENTS

| | | | |
|---|---|---|---|
| 3,920,972 | 11/1975 | Corwin, Jr. et al. | 235/151.11 |
| 4,288,196 | 9/1981 | Sutton, II | 414/699 |
| 4,420,812 | 12/1983 | Ito et al. | 364/513 |
| 4,829,418 | 5/1989 | Nielsen et al. | 364/167.01 |
| 5,308,219 | 5/1994 | Lee et al. | 414/695.5 |
| 5,490,081 | 2/1996 | Kuromoto et al. | 364/474.2 |
| 5,735,065 | 4/1998 | Yamagata et al. | 37/348 |
| 5,887,365 * | 3/1999 | Fujishima et al. | 37/348 |

FOREIGN PATENT DOCUMENTS

| | | |
|---|---|---|
| 681067 | 11/1995 | (EP) . |
| 58-98530 | 6/1983 | (JP) . |
| 2-252826 | 10/1990 | (JP) . |
| 4-136324 | 5/1992 | (JP) . |
| 8-20974 | 1/1996 | (JP) . |
| 8-158408 | 6/1996 | (JP) . |
| WO95/30059 | 9/1995 | (WO) . |

* cited by examiner

*Primary Examiner*—William A. Cuchlinski, Jr.
*Assistant Examiner*—Yonel Beaulieu
(74) *Attorney, Agent, or Firm*—Beall Law Offices

(57) ABSTRACT

A setting device for a front control system for a construction machine includes a direct setting switch for instructing a direct teaching setting, a numeral input key consisting of up- and down-keys for instructing a numeral input setting, a setting changeover switch for changing over a setting mode from the direct teaching setting to the numeral input setting, an LED lighting up when the setting changeover switch is pushed, an area limiting switch for starting an area limiting excavation control, an LED lighting up when the area limiting switch is pushed, and a display screen for indicating the position of a bucket end of a front device in terms of a numeral value when the setting changeover switch is not pushed, and indicating the numeral value input with the numeral input with the numeral input setting when the setting changeover switch is pushed.

24 Claims, 21 Drawing Sheets

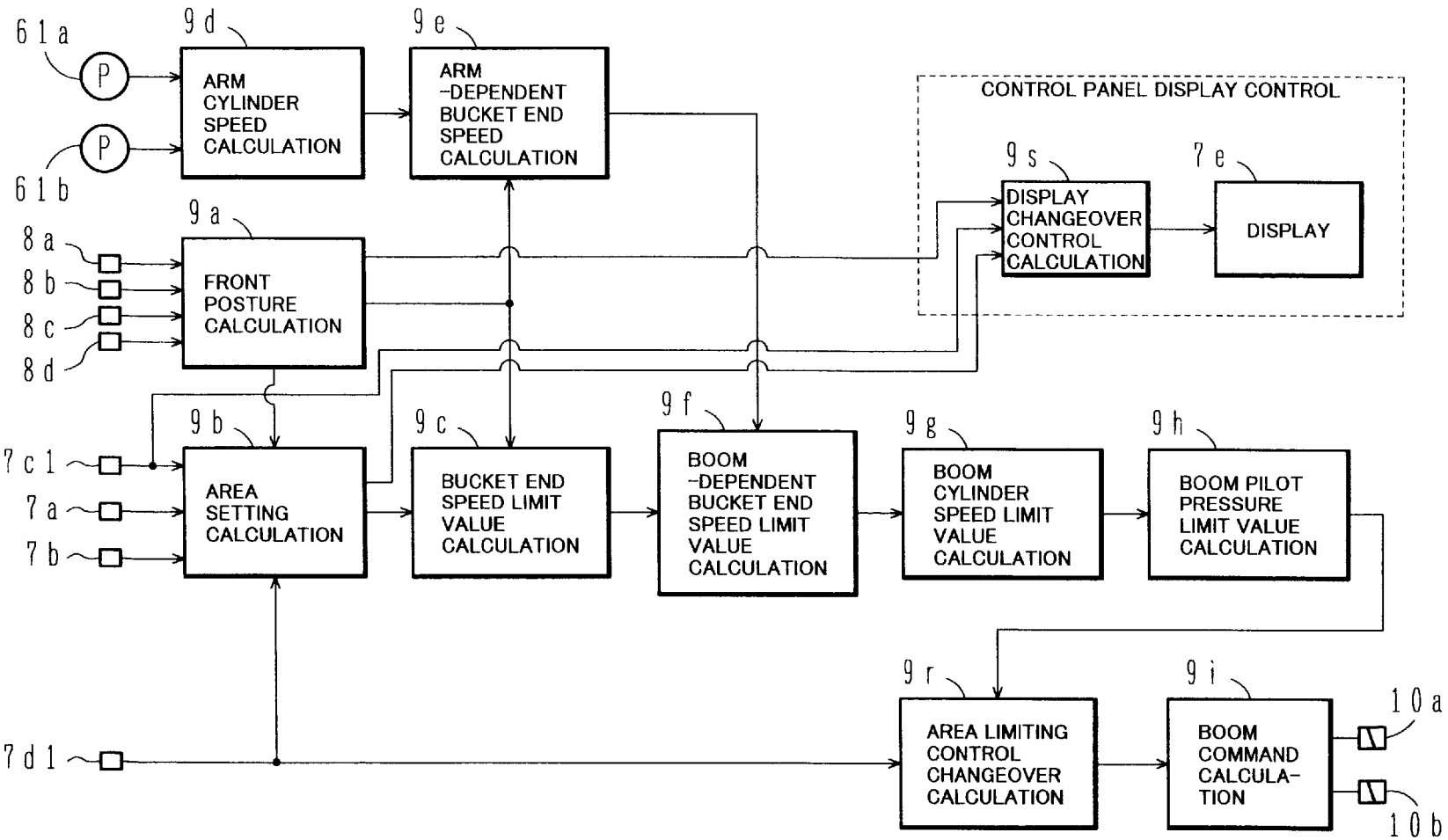
FIG.4
CONTROL PANEL DISPLAY CONTROL
DISPLAY
7e
DISPLAY CHANGEOVER CONTROL CALCULATION
9s
ARM -DEPENDENT BUCKET END SPEED CALCULATION
9e
ARM CYLINDER SPEED CALCULATION
9d
FRONT POSTURE CALCULATION
9a
BOOM -DEPENDENT BUCKET END SPEED LIMIT VALUE CALCULATION
9f
BUCKET END SPEED LIMIT VALUE CALCULATION
9c
AREA SETTING CALCULATION
9b
BOOM CYLINDER SPEED LIMIT VALUE CALCULATION
9g
BOOM PILOT PRESSURE LIMIT VALUE CALCULATION
9h
AREA LIMITING CONTROL CHANGEOVER CALCULATION
9r
BOOM COMMAND CALCULA-TION
9i
10a
10b
61a
61b
8a
8b
8c
8d
7c1
7a
7b
7d1

FRONT CONTROL SYSTEM, AREA SETTING METHOD AND CONTROL PANEL FOR CONSTRUCTION MACHINE

BACKGROUND OF THE INVENTION

1. Field of the Invention

The present invention relates to a construction machine having a multi-articulated front device, and more particularly to a front control system for a construction machine, e.g., a hydraulic excavator having a front device comprising a plurality of front members such as an arm, a boom and a bucket, which system is adapted for front control, e.g., area limiting excavation control to limit an area where the front device is allowed to move for excavation. The present invention also relates to an area setting method for use in the front control and a control panel for use with the front control system.

2. Description of the Related Art

There is known a hydraulic excavator as a typical one of construction machines. In a hydraulic excavator, front members, such as a boom and an arm, making up a front device are operated by an operator manipulating respective manual control levers. However, because the front members are coupled to each other through articulations for relative rotation, it is very difficult to carry out excavation work within a predetermined area or in a predetermined plane by operating the front members. Also, when excavation work is performed in urban districts and so forth, due care must be paid to keep the front device from interfering with surrounding objects, e.g., electric wires and walls.

In view of the above-mentioned state of art, various proposals for facilitating excavation work or preventing interference between the front device and surrounding objects have been made.

For example, according to JP, A, 4-136324, a slowdown area is set in a position before reaching an entrance forbidden area, and a front device is slowed down by reducing an operation signal input from a control lever when a part, e.g., a bucket, of the front device enters the slowdown area, and is stopped when the bucket reaches the boundary of the entrance forbidden area. Also, this related art employs, as an area setting method, one mode in which the operator moves a bucket end onto the target boundary and pushes a switch there (direct teaching setting mode), or the other mode in which the operator inputs necessary numeral values through numeral input keys (numeral input setting mode).

Further, according to WO 95/30059, an area to be excavated is set beforehand, and a part, e.g., a bucket, of a front device is controlled to slow down its movement only in the direction toward the excavation area when the bucket comes close to the boundary of the excavation area, and to be able to move along the boundary of the excavation area without going out of the excavation area when the bucket reaches the boundary of the excavation area. Also, this related art discloses an area setting method in which the operator moves a bucket end onto the target boundary and pushes a switch there (direct teaching setting mode).

SUMMARY OF THE INVENTION

When the operator sets an area where the front device is forbidden from entering, which one of the above setting modes is more convenient depends on the type of scheduled work.

For example, when the ground should be generally leveled by rough excavation in the work site where an area to be excavated is not especially defined by numerals put on the drawing or the like, it is convenient for the operator to move a bucket end directly to a limit position of the excavation and perform setting operation, e.g., push a button or the like, thereby setting the area based on coordinate values of the bucket end (direct teaching setting). In some work sites, however, the depth by which the ground is to be excavated from the level of a hydraulic excavator on the ground surface is specified in unit of meter. In such a case, it is convenient to set an excavation area by an actual numeral value beforehand (numeral input setting). Furthermore, work of gradually proceeding with excavation from the ground surface and digging up a pipe (water service pipe or the like) buried in earth requires the excavation to be first roughly made to some extent without any control and then finely made under area limiting excavation control from a certain depth. In this case, it is convenient to excavate the ground roughly to some extent without any control, then set the position reached at that time by the direct teaching, setting mode and then proceed with the excavation gradually in steps of several centimeters in such a manner as like carefully peeling off a thin skin while setting the depth in a gradually increasing value with the above set position as a base, thus digging up the target pipe.

However, the above related-art systems include only one area setting means, i.e., means for the direct teaching setting or means for the numeral input setting. This has raised a problem that the operator can neither always select optimum area setting means in any of the work sites nor take appropriate and prompt actions for various types of works.

In addition, during the operation under front control with the area setting described above, it is often desired to cancel the control for a while. For example, work of burring a water service pipe or the like in the ground is carried out with a hydraulic excavator by excavating a predetermined length of trench to a certain depth, then lifting the pipe and installing it in the trench at a predetermined position, and then excavating another length of trench. In other words, trench digging and pipe burring are repeated alternately. When the trench digging in such work is performed under area limiting excavation control, for example, the work is proceeded with in a sequence of excavating a predetermined length of trench, turning off a control start switch on a control panel to bring the area limiting excavation control to an end once, lifting the pipe with a crane for desired installation, turning on the control start switch, and setting the excavation area again to excavate another length of trench. This results in complicated operation and makes the operator feel impatient therewith.

A first object of the present invention is to provide a front control system for a construction machine, an area setting method and a control panel for use with the front control system, by which the operator can always select optimum area setting means in any of work sites and take appropriate and prompt actions for various types of works.

A second object of the present invention is to provide a front control system for a construction machine, which can cancel front control temporarily and simply resume the front control after the temporary cancellation.

(1) To achieve the above first object, the present invention provides a front control system equipped on a construction machine comprising a multi-articulated front device made up of a plurality of front members rotatable in the vertical direction, a plurality of hydraulic actuators for driving respectively the plurality of front members, and a plurality of hydraulic control valves driven in accordance with respective operation signals input from a plurality of operating means for controlling flow rates of a hydraulic fluid supplied to the plurality of hydraulic actuators, the front control system controlling the front device to be moved in a preset area, wherein the front control system comprises first area setting means having a direct setting switch for setting an area where the front device is allowed to move, by direct teaching in response to an instruction from the direct setting switch, second area setting means having a numeral input switch for setting an area where the front device is allowed to move, by inputting a numeral value through the numeral input switch, and setting selection means for selecting one of the first area setting means and the second area setting means.

In the present invention thus constructed, the front control system includes two area setting means, i.e., the first area setting means capable of direct teaching setting and the second area setting means capable of numeral input setting, and can select one of the two area setting means by the setting selection means. Therefore, the operator can select optimum area setting means in any of work sites and take appropriate and prompt actions for various types of works.

(2) In the above (1), preferably, the front control system further comprises display means for displaying the numeral value input through the numeral input switch of the second area setting means.

With this feature, since the operator can make the numeral input setting while looking at the numeral value displayed on the display means, the numeral input setting can be precisely and promptly performed.

(3) In the above (1), preferably, the setting selection means has a setting changeover switch for enabling one of the first area setting means and the second area setting means to be selected when the setting changeover switch is not operated, and enabling the other of the first area setting means and the second area setting means to be selected when the setting changeover switch is operated.

With this feature, by operating one switch of the first area setting means and the second area setting means, the setting can be performed by the one area setting means even with the setting changeover switch not operated. By operating the setting changeover switch, a setting mode is changed over to the setting by the other area setting means. Therefore, the setting changeover can be rationally achieved with a minimum switching operation.

(4) In the above (3), preferably, the setting selection means enables the first area setting means to be selected regardless of whether the setting changeover switch is operated or not, when the direct setting switch of the first area setting means is operated, and enables the second area setting means to be selected when the setting changeover switch is operated.

With this feature, by operating the direct setting switch of the first area setting means, the direct teaching setting can be made with no need of operating the setting changeover switch. Thus, the area setting can be performed with priority given to the direct teaching setting.

(5) In the above (4), the front control system further comprises display means, and display changeover means for instructing the display means to display a current position of the front device when the setting changeover switch is not operated, and instructing the display means to display the numeral value input through the numeral input switch of the second area setting means when the setting changeover switch is operated.

With this feature, during the front control and the direct teaching setting, the current position of the front device is displayed on the display means, and the operator can perform work while confirming the current position of the front device on the display means. During the numeral input setting, the numeral value input through the numeral input switch is displayed on the display means, and the operator can proceed with the setting while looking at the numeral value displayed on the display means.

(6) In the above (1), preferably, the numeral input switch of the second area setting means comprises a first numeral input key for increasing an input numeral value from a certain base value, and a second numeral input key for reducing an input numeral value from a certain base value.

With this feature, the operator can freely make the numeral input setting by using the two keys.

(7) In the above (1), preferably, the second area setting means previously sets, as an initial value, a value representing a position to which the front device cannot reach, and changes a set numeral value through the numeral input switch with the initial value as a base, thereby setting the area.

With this feature, when the numeral input setting is made by the second area setting means, the area can be set to a desired position by using, as a base, the value representing a position to which the front device cannot reach.

(8) In the above (1), preferably, the second area setting means changes a set numeral value through the numeral input switch with the numeral value set by the direct teaching as a base, thereby setting the area.

With this feature, in such work as gradually proceeding excavation from the ground surface and digging up a pipe buried in earth is performed by first roughly excavating the earth some extent without any control, and then setting a greater depth step by step from a certain depth by inputting numeral values with the position set by the direct teaching as a base, so that the excavation is gradually proceeded with in steps of several centimeters in such a manner as like carefully peeling off a thin skin. It is thus possible to quickly dig up the target pipe without damaging it.

(9) In the above (1), preferably, the front control system further comprises a control selection switch for selecting whether the front device is to be controlled or not, and initializing means for setting, as an initial value of the area to be set, a value representing a position to which the front device cannot reach, each time when the control selection switch is operated for selection of front control.

With this feature, when the front control is selected, the position to which the front device cannot reach is always set initially. This enables the front device to freely move over a full range where it is inherently operable, for free setting of the excavation area within that full operable range.

(10) Also, to achieve the above second object, according to the present invention, the front control system for a construction machine of above (1) further comprises control means for controlling operation of the front device by modifying the operation signal so that the front device is allowed to move within an area set by one of the first area setting means and the second area setting means, a temporary cancel switch, and control cancel means for temporarily cancelling control of the front device performed by the control means when the temporary cancel switch is pushed.

By providing the temporary cancel switch so that the front control executed by the control means can be temporarily cancelled, an excavation mode can be easily changed over between excavation under the normal control and excavation under the area limiting control. It is thus possible to quickly and smoothly perform digging work requiring a combination of the normal excavation and the excavation under the area limiting control, such as work of burying a water service pipe or the like in the ground by alternately repeating trench digging for which the excavation under the area limiting control is more convenient and pipe installation for which the normal excavation is more convenient.

(11) In the above (10), preferably, the temporary cancel switch is provided on a lever grip of one of the plurality of control lever means.

By providing the temporary cancel switch on the lever grip of the control lever, the operator can promptly change over the normal excavation and the excavation under the area limiting control from one to the other without releasing his hand from the control lever.

(12) In the above (10), preferably, the direct setting switch and the numeral input switch are provided on a box-type control panel installed in a cab, and the temporary cancel switch is provided on a lever grip of one of the plurality of control lever means.

With this feature, the operator can set an area to be excavated by using the direct setting switch or the numeral input switch on the control panel prior to the start of work, and during the work, can promptly change over the normal excavation and the excavation under the area limiting control from one to the other without releasing his hand from the control lever, by using the temporary cancel switch provided on the lever grip of the control lever means.

(13) In the above (12), preferably, the first area setting means further includes another direct setting switch provided on the lever grip for instructing setting of the area where the front device is allowed to move.

By providing not only the temporary cancel switch but also another direct setting switch on the lever grip of the control lever means, the operator can also promptly set the excavation area without releasing his hand from the control lever. This makes the operator not feel troublesome in setting the excavation area.

(14) In the above (13), preferably, the temporary cancel switch and the direct setting switch both provided on the lever grip have surface configurations different from each other.

With this feature, while the direct setting switch and the temporary cancel switch are both installed on the same control lever, the operator can discern the respective functions of the two switches just by touching them without visually confirming the switches, resulting in quicker and smoother operation.

(15) In the above (11) or (12), preferably, the control lever means on which the temporary cancel switch is provided is the control lever means for a boom of a hydraulic excavator.

By providing the direct setting switch on the control lever of the boom control lever means which instructs the vertical movement of the front device, the operator can push the temporary cancel switch to change over the excavation mode between the normal excavation and the excavation under the area limiting control while manipulating the control lever to move the boom with the same hand. Also, when the direct setting switch is provided on the control lever of the above control lever means, the operator can set the area with his one hand while manipulating the control lever to move the boom with the same hand. As a result, the height can be easily adjusted in setting the area and the delicate setting is facilitated.

(16) In the above (10), preferably, the control cancel means is means for interrupting modification of the operation signal made by the control means when the temporary cancel switch is pushed.

By interrupting modification of the operation signal, the control of the front device is temporarily suspended.

(17) In the above (10), preferably, the control cancel means is means for temporarily changing the set position of a boundary of the area to a value representing a position to which the front device cannot reach, when the temporary cancel switch is pushed.

By temporarily changing the set position of the boundary of the area, the control of the front device is made essentially infeasible and cancelled for a while.

(18) Further, to achieve the above first object, the present invention provides an area setting method for use in front control under which a multi-articulated front device made up of a plurality of front members rotatable in the vertical direction is controlled so that the front device is moved in a preset area, comprising the steps of moving the front device to a position as a reference, storing the position by direct teaching, setting a depth by inputting a numeral value with the stored position as a base, and setting an area where the front device is allowed to move, in accordance with a numeral value resulted from the depth setting.

With this feature, in such work as gradually proceeding excavation from the ground surface and digging up a pipe buried in earth, it is possible to quickly dig up the target pipe similarly to the above (8).

(19) Furthermore, to achieve the above first object, the present invention provides a control panel of a front -control system equipped on a construction machine comprising a multi-articulated front device made up of a plurality of front members rotatable in the vertical direction, a plurality of hydraulic actuators for driving respectively the plurality of front members, and a plurality of hydraulic control valves driven in accordance with respective operation signals input from a plurality of operating means for controlling flow rates of a hydraulic fluid supplied to the plurality of hydraulic actuators, the front control system controlling the front device to be moved in a preset area, wherein the control panel comprises a direct setting switch for instructing by direct teaching setting of an area where the front device is allowed to move, a numeral input switch for instructing by input of a numeral value setting of an area where the front device is allowed to move, and a setting changeover switch for selecting one of the setting instructions from the direct setting switch and the numeral input switch.

With this feature, similarly to the above (1), the operator can select optimum area setting means in any of work sites and take appropriate and prompt actions for various types of works.

(20) In the above (19), preferably, the control panel further comprises display means for displaying the numeral value input through the numeral input switch.

With this feature, the operator can precisely make the numeral input setting while looking at the numeral value displayed on the display means. (21) In the above (19), preferably, the control panel further comprises display means for displaying a current position of the front device when the setting changeover switch is not operated, and displaying the numeral value input through the numeral input switch when the setting changeover switch is operated, With this feature, the operator can obtain information about the position of the front device as well from the display means.

(22) In the above (19), preferably, the numeral input switch comprises a first numeral input key for increasing an input numeral value from a certain base value, and a second numeral input key for reducing an input numeral value from a certain base value.

(23) In the above (19), preferably, the control panel further comprises a control selection switch for selecting whether the front device is to be controlled or not, whereby selection of the control of the front device by the control selection switch enables the direct setting switch and the numeral input switch to instruct the setting.

BRIEF DESCRIPTION OF THE DRAWINGS

FIG. 4 is a functional block diagram showing control functions of a control unit.

DETAILED DESCRIPTION OF THE PREFERRED EMBODIMENTS

Several embodiments of the present invention in which the invention is applied to an area limiting excavation control system for a hydraulic excavator will be described hereunder with reference to the drawings.

To begin with, a first embodiment of the present invention will be described with reference to FIGS. 1 to 10.

Figure 1:
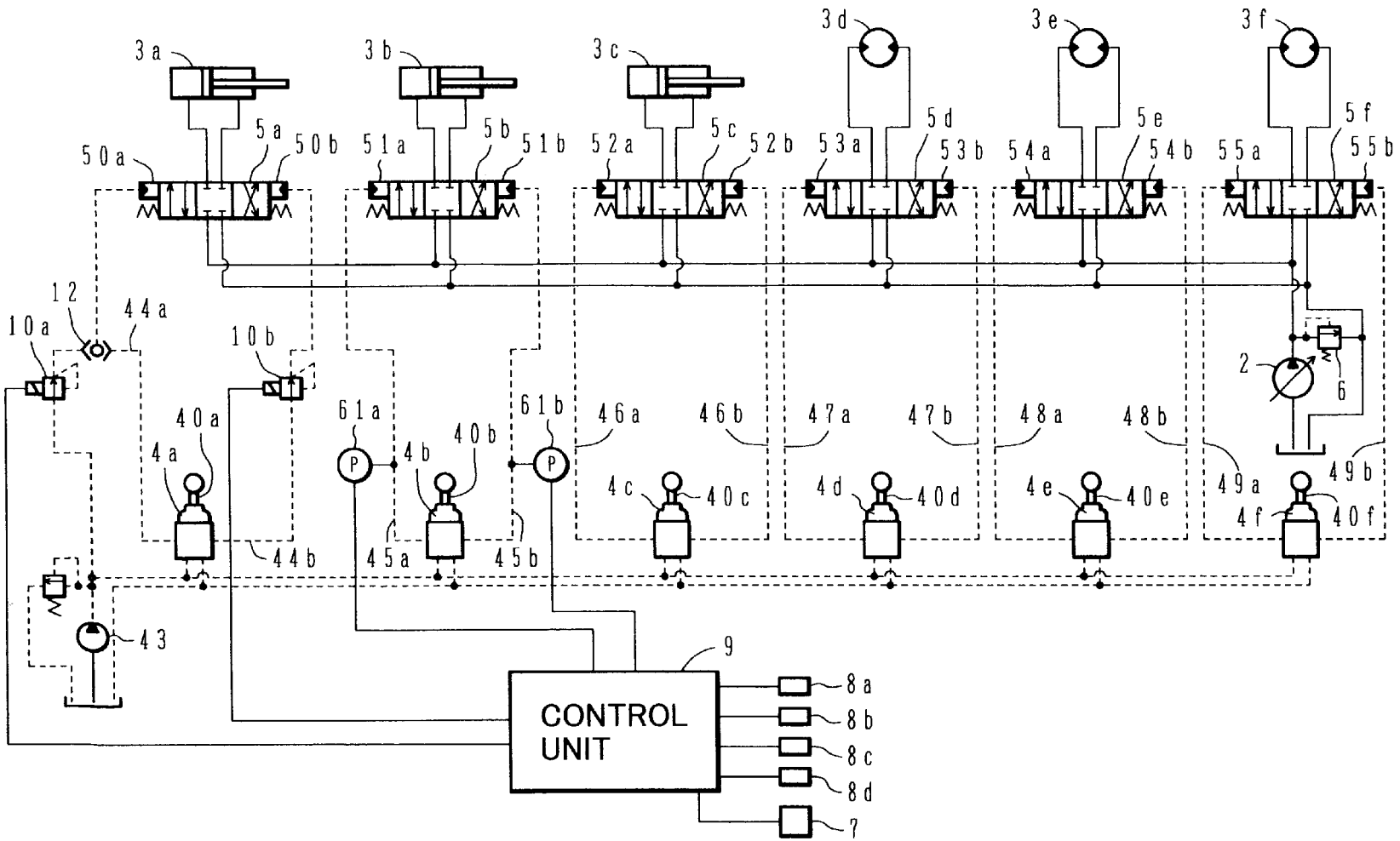
FIG. 1 is a diagram showing a front control system for a construction machine according to a first embodiment of the present invention, along with a hydraulic drive system thereof.

In FIG. 1, a hydraulic excavator to which the present invention is applied comprises a hydraulic pump 2, a plurality of hydraulic actuators driven by a hydraulic fluid from the hydraulic pump 2, including a boom cylinder 3*a*, an arm cylinder 3*b*, a bucket cylinder 3*c*, a swing motor 3*d* and left and right track motors 3*e*, 3*f*, a plurality of control lever units 4*a*–4*f* provided respectively associated with the hydraulic actuators 3*a*–3*f*, a plurality of flow control valves 5*a*–5*f* connected between the hydraulic pump 2 and the plurality of hydraulic actuators 3*a*–3*f* and controlled in accordance with respective operation signals input from the control lever units 4*a*–4*f* for controlling respective flow rates of the hydraulic fluid supplied to the hydraulic actuators 3*a*–3*f*, and a relief valve 6 which is opened when the pressure between the hydraulic pump 2 and the flow control valves 5*a*–5*f* exceeds a preset value. The above components cooperatively make up a hydraulic drive system for driving driven members of the hydraulic excavator.

Figure 2:
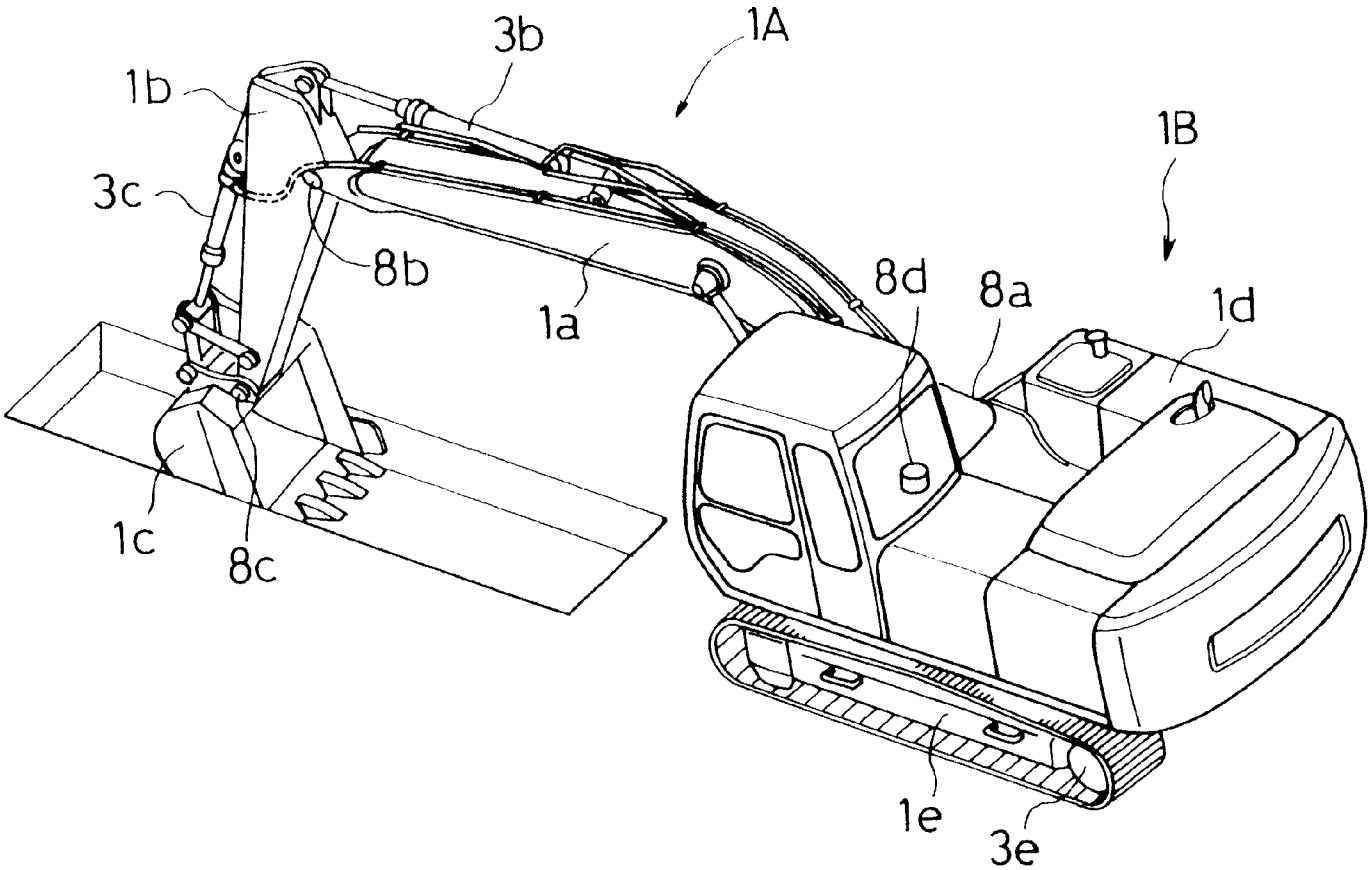
FIG. 2 is a view showing an appearance of a hydraulic excavator to which the present invention is applied.

As shown in FIG. 2, the hydraulic excavator is made up of a multi-articulated front device 1A comprising a boom 1*a*, an arm 1*b* and a bucket 1*c* which are each rotatable in the vertical direction, and a body 1B comprising an upper structure 1*d* and an undercarriage 1*e*. The boom 1*a* of the front device 1A is supported at its base end to a front portion of the upper structure 1*d*. The boom 1*a*, the arm 1*b*, the bucket 1*c*, the upper structure 1*d* and the undercarriage 1*e* serve as driven members which are driven respectively by the boom cylinder 3*a*, the arm cylinder 3*b*, the bucket cylinder 3*c*, the swing motor 3*d* and the left and right track motors 3*e*, 3*f*. These driven members are operated in accordance with instructions from the control lever units 4*a*–4*f*.

Further, the control lever units 4*a*–4*f* are of hydraulic pilot type each generating a pilot pressure depending on the input amount and the direction by and in which the control levers 40*a*–40*f* are each manipulated by the operator, and supplying the pilot pressure to a corresponding one of hydraulic driving sectors 50*a*–55*b* of the flow control valves 5*a*–5*f* through pilot lines 44*a*–49*b*, thereby driving these flow control valves.

An area limiting excavation control system of this embodiment is equipped on the hydraulic excavator constructed as explained above. The control system comprises a setting device 7 for providing an instruction to set an excavation area where a predetermined part of the front device, e.g., an end of the bucket 1*c*, is allowed to move for excavation, depending on the scheduled work beforehand, angle sensors 8*a*, 8*b*, 8*c* disposed respectively at pivot points of the boom 1*a*, the arm 1*b* and the bucket 1*c* for detecting respective rotational angles thereof as status variables in relation to the position and posture of the front device 1A, a tilt angle sensor 8*d* for detecting a tilt angle of the body 1B in the back-and-forth direction, pressure sensors 61*a*, 61*b* disposed in the pilot lines 45*a*, 45*b* of the arm control lever unit 4*b* for detecting respective pilot pressures representative of the input amount by which the control lever unit 4*b* is operated, a proportional solenoid valve 10*a* connected at its primary port side to a pilot pump 43 for reducing a pilot pressure from the pilot pump 43 in accordance with an electric signal applied thereto and outputting the reduced pilot pressure, a shuttle valve 12 connected to the pilot line 44*a* of the boom control lever unit 4*a* and the secondary port side of the proportional solenoid valve 10*a* for selecting a higher one of the pilot pressure in the pilot line 44*a* and the control pressure delivered from the proportional solenoid valve 10*a* and introducing the selected pressure to the hydraulic driving sector 50*a* of the flow control valve 5*a*, a proportional solenoid valve 10*b* disposed in the pilot line 44*b* of the boom control lever unit 4*a* for reducing the pilot pressure in the pilot line 44*b* in accordance with an electric signal applied thereto and outputting the reduced pilot pressure, and a control unit 9 for receiving a setup signal from the setting device 7 and detection signals from the angle sensors 8*a*, 8*b*, 8*c*, the tilt angle sensor 8*d* and the pressure sensors 61*a*, 61*b*, setting the excavation area where the end of the bucket 1*c* is allowed to move, and outputting to the proportional solenoid valves 10*a*, 10*b* electric signals for modifying the operation signals to carry out control for excavation within a limited area.

Figure 3:
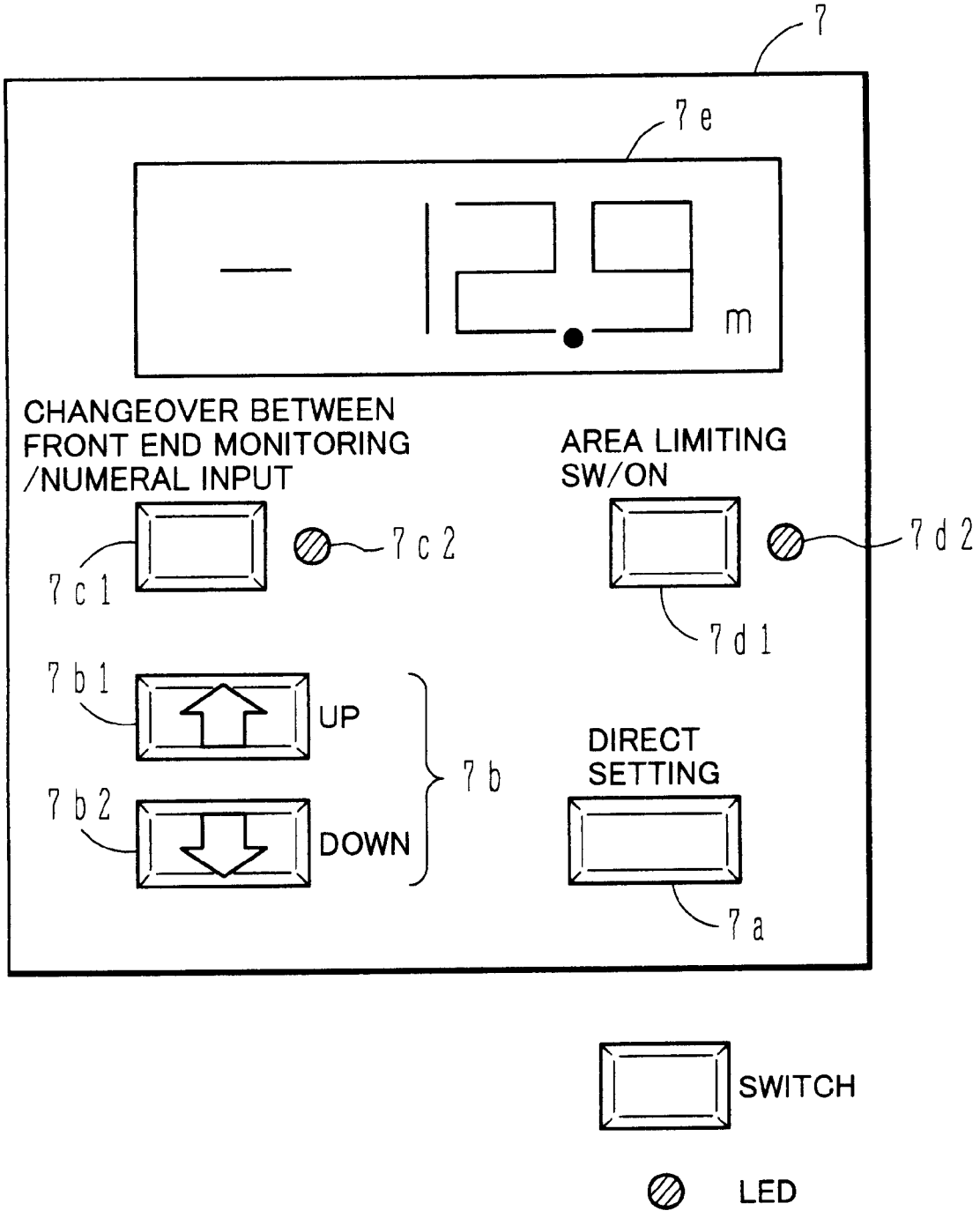
FIG. 3 is an illustrative view showing an appearance of a setting device.

The setting device 7 outputs a setup signal to the control unit 9 to instruct setting of the excavation area. As shown in FIG. 3, the setting device 7 comprises a direct setting switch 7*a* for instructing the direct teaching setting, a numeral input key 7*b* consisting of an up-key 7*b*1 and a down-key 7*b*2 for instructing the numeral input setting, a setting changeover switch 7*c*1 pushed when a setting mode is to be changed from the direct teaching setting to the numeral input setting, an LED 7*c*2 lighting up when the setting changeover switch 7*c*1 is pushed, an area limiting switch 7*d*1 pushed when the area limiting excavation control is to be performed, an LED 7*d*2 lighting up when the area limiting switch 7*d*1 is pushed, and a display screen 7*e* comprised of liquid crystals, etc. for indicating the position of the bucket end of the front device 1A in terms of a numeral value when the setting changeover switch 7*c*1 is not pushed, and indicating the numeral value input with the numeral input setting when the setting changeover switch 7*c*1 is pushed.

Further, the setting device 7 is constructed of a box-type control panel, for example, and installed in a position above a standard control panel, which is usually installed in a cab forwardly of an operator's seat, and out of interference with a visual field of the operator, e.g., in a front corner of the cab.

FIG. 4 shows control functions of the control unit 9. The control unit 9 has various functions executed by a front posture calculating portion 9*a*, an area setting calculating portion 9*b*, a bucket end speed limit value calculating portion 9*c*, an arm cylinder speed calculating portion 9*d*, an arm-dependent bucket end speed calculating portion 9*e*, a boom-dependent bucket end speed limit value calculating portion 9*f*, a boom cylinder speed limit value calculating portion 9*g*, a boom pilot pressure (boom command) limit value calculating portion 9*h*, an area limiting control changeover calculating portion 9*r*, a boom command calculating portion 9*i*, and a display changeover control calculating portion 9*s*.

The front posture calculating portion 9*a* calculates the position and posture of the front device 1A based on the respective rotational angles of the boom, the arm and the bucket detected by the angle sensors 8*a*–8*c*, as well as the tilt angle of the body 1B in the back-and-forth direction detected by the tilt angle sensor 8*d*. One example of the calculation process will be described with reference to FIG. 5. Note that the following example is to calculate the position of a bucket prong end $P_1$ of the front device 1A excepting the tilt angle detected by the tilt angle sensor 8*d* for the sake of brevity.

Figure 5:
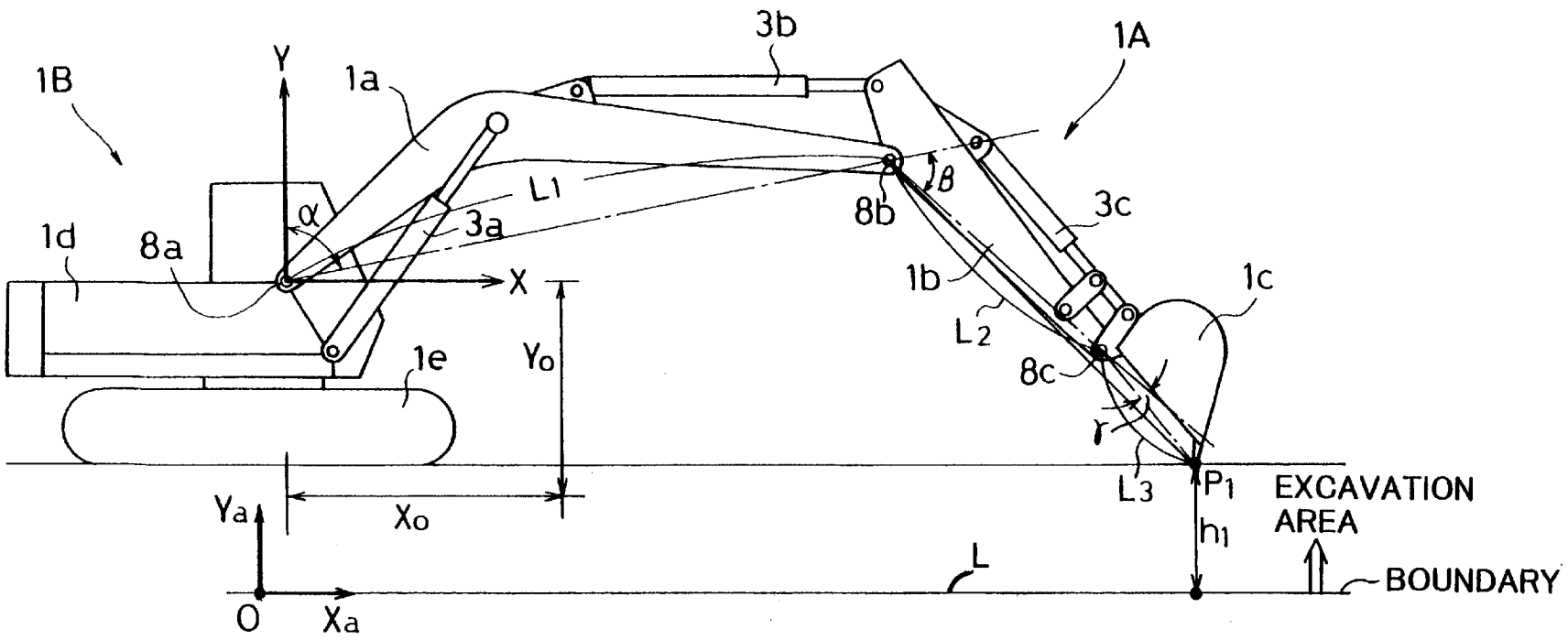
FIG. 5 is a side view for explaining a manner of setting an excavation area for use in area limiting excavation control according to the first embodiment.

Referring to FIG. 5, the control unit 9 stores various dimensions of the front device 1A and the body 1B in its memory, and the front posture calculating porion 9*a* calculates the position of the bucket end $P_1$ based on the stored data and the values of rotational angles α, β, γ detected respectively by the angle sensors 8*a*, 8*b*, 8*c*. At this time, the position of $P_1$ is determined as coordinate values (X, Y) on an XY-coordinate system with the origin defined by, for example, the pivot point of the boom 1*a*. The XY-coordinate system is a rectangular coordinate system fixed on the body 1B and lying in a vertical plane. Given that the distance between the pivot point of the boom 1*a* and the pivot point of the arm 1*b* is $L_1$, the distance between the pivot point of the arm 1*b* and the pivot point of the bucket 1*c* is $L_2$, and the distance between the pivot point of the bucket 1*c* and the end of the bucket 1*c* is $L_3$, the coordinate values (X, Y) on the XY-coordinate system are determined from the rotational angles α, β, γ by using formulae below:

$$X=L_1 \sin\alpha+L_2 \sin(\alpha+\beta)+L_3 \sin(\alpha+\beta+\gamma)$$

$$Y=L_1 \cos\alpha+L_2 \cos(\alpha+\beta)+L_3 \cos(\alpha+\beta+\gamma)$$

The area setting calculating portion 9*b* executes setting of an excavation area where the end of the bucket 1*c* is allowed to move for excavation, in response to an instruction from the setting device 7 by the direct teaching setting with the direct setting switch 7*a* or the numeral input setting with the numeral input switch 7*b*. One example of the setting process will be described with reference to FIGS. 5 and 6. In this example, a boundary L of the excavation area is set as a straight line parallel to the X-axis at a depth h,.

Figure 6:
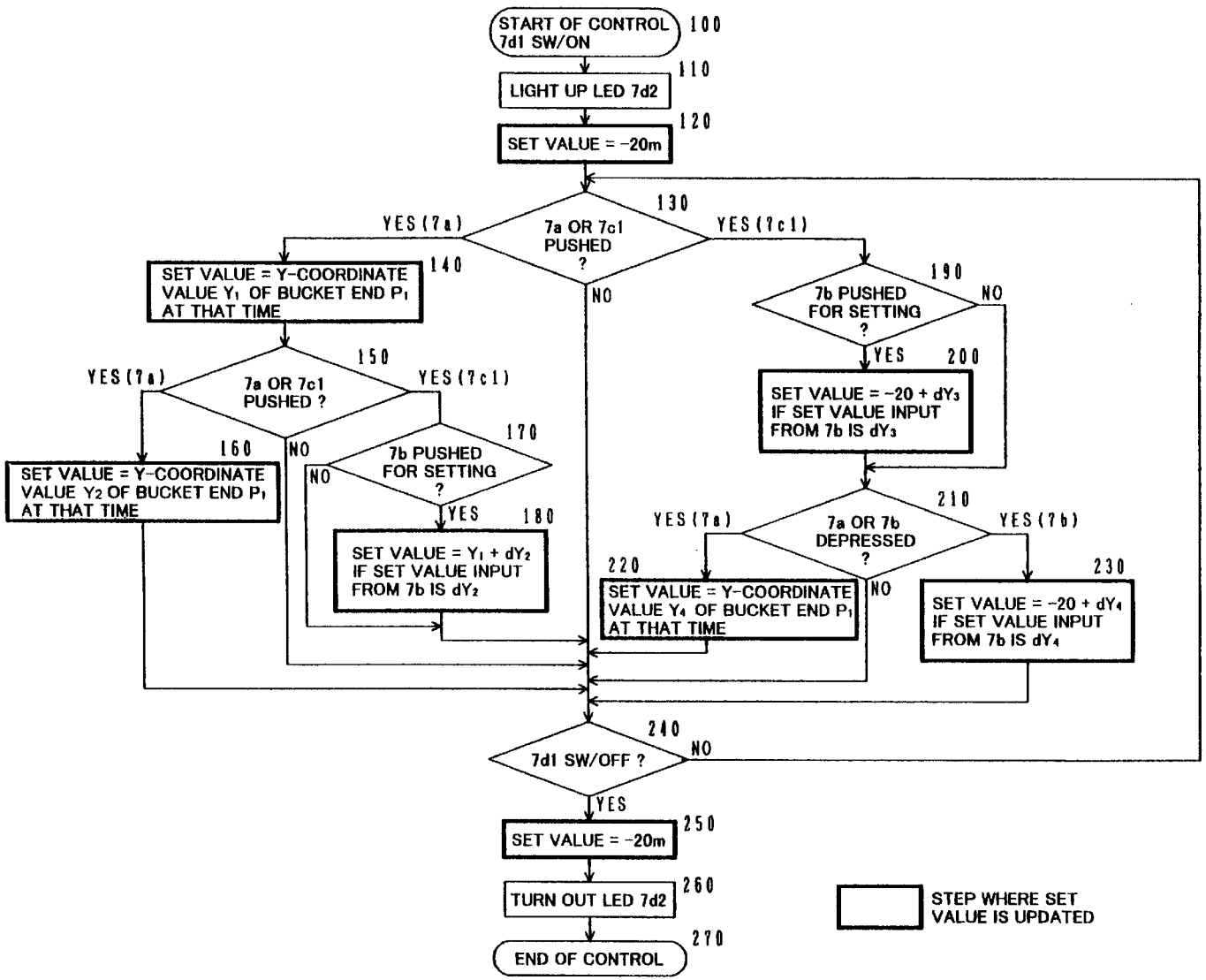
FIG. 6 is a flowchart showing processing steps executed in an area setting calculation portion.

Referring to FIG. 6, the area limiting excavation control in this embodiment is started by turning on (pushing) the area limiting switch 7*d*1 (step 100). The turning-on of the area limiting switch 7*d*1 lights up the LED 7*d*2 (step 110). Then, a value representing a so deep position that the bucket cannot reach there is set as an initial value of the boundary L (depth $h_1$) of the excavation area (step 120). This enables the front device 1A to freely move over a full range where it is inherently operable, for free setting of the excavation area within that full operable range. Here, the initial value of the boundary L of the excavation area is set to, as one example, Y=−20 m.

Next, the boundary L of the excavation area is set as follows by operating the direct setting switch 7*a*, the numeral input switch 7*b* and the setting changeover switch 7*c*1 in a combined manner.

(a) Direct Teaching Setting

After moving the end $P_1$ of the bucket 1*c* to a target position, the operator pushes the direct setting switch 7*a*. Upon the direct setting switch 7*a* being pushed, the area setting calculating portion 9*b* always sets the boundary L of the excavation area below by using the Y-coordinate value, $Y=Y_1$, $Y_2$, $Y_4$. of the bucket end $P_1$ calculated in the front posture calculating portion 9*a* at that time;

set value=Y-coordinate value $Y_1$ (step 140)

set value=Y-coordinate value $Y_2$ (step 160)

set value=Y-coordinate value $Y_4$ (step 220)

(these setting processes follow respective paths; (1) steps 130→140→150→240→130→240; (2) steps 130→140→150→160→240→130→240; and paths; (3) steps 130→190→200 or 210→220→240→130→240.

(b) Numeral Input Setting

When the setting changeover switch 7c1 is pushed to select the numeral input setting and the direct teaching setting will never be performed after that, the area setting calculating portion 9b sets the boundary L of the excavation area upon operation of the up-key 7b1 or the down-key 7b2 of the numeral input switch 7b below by using the initial value Y=−20 m as a base (reference) and adding a change $dY_3$, $dY_4$ input from the up- or down-key 7b1, 7b2 to the initial value;

set value=$-20+dY_3$ (step 200)

set value=$-20+dY_4$ (step 230)

(these setting processes follow respective paths; (1) steps 130→190→200→210→240→130→240; and (2) steps 130→190→200 or 210→230→240→130→240.

(c) Direct Teaching Setting→Numeral Input Setting

When the setting changeover switch 7c1 is pushed to select the numeral input setting and the up-key 7b1 or the down-key 7b2 of the numeral input switch 7b is operated after the direct teaching setting has been once performed, the area setting calculating portion 9b sets the boundary L of the excavation area below by using the value $Y_1$ set by the direct teaching as a base and adding a change $dY_2$ input from the up- or down-key 7b1, 7b2 to that set value;

set value=$Y_1+dY_2$ (step 180)

(this setting process follows a path of steps 130→140→150→170→180→240→130→240).

Even with $Y_1+dY_2$ thus once set, if the direct setting switch 7a is pushed as mentioned in the above (a), the direct teaching setting proceeded. Therefore, if the setting changeover switch 7c1 is pushed and a numeral value is input upon operation of the up- or down-key 7b1, 7b2 after that, the area setting calculating portion 9b sets the boundary L of the excavation area below by making calculation using a value $Y_1$ newly set by the direct teaching as a base;

set value=$Y_1+dY_2$ (step 180)

(this setting process follows a path of steps 130→140→150→170→180→240→130→140→150→170→180→240→130→240).

When the direct teaching setting is performed by positioning the bucket end on the ground surface and designating the level of the ground surface as a set value, as shown in FIG. 5, the change $dY_2$ input through the down-key 7b2 represents the depth hl. This means that the operator eventually inputs the depth h, in a numeral value.

In the above (b) and (c), the change set upon operation of the up- or down-key 7b1, 7b2 is not particularly restricted in value to be input. However, setting to such a value as representing the position not reachable by the front device 1A is meaningless from the practical point of view. Accordingly, the change set upon operation of the up- or down-key 7b1, 7b2 is specified as a value within the range or area reachable by the front device 1A. It is here, by way of example, assumed that a value up to ±20 m is allowed to input and any value beyond such a limit cannot be input.

When the area limiting excavation control in this embodiment is to be ended, the area limiting switch 7d1 is turned off by pushing it again (step 240). For safety, the set value of the boundary L of the excavation area is reset to the initial value of Y=−20 m (step 250). The LED 7d2 is turned out (step 260) and the control flow is then brought to an end (step 270).

After setting the boundary L of the excavation area as described above, the area setting calculating portion 9b derives a formula of a straight line expressing the boundary L of the excavation area, establishes an XaYa-coordinate system which is a rectangular coordinate system having the origin located on that straight line and one axis defined by that straight line, and determines transform data from the XY-coordinate system to the XaYa-coordinate system.

The bucket end speed limit value calculating portion 9c calculates a limit value a of the component of the bucket end speed vertical to the boundary L of the set area depending on a distance D to the bucket end from the boundary L. This calculation is carried out by storing the relationship as shown in FIG. 7 in the memory of the control unit 9 beforehand and reading out the stored relationship.

Figure 7:
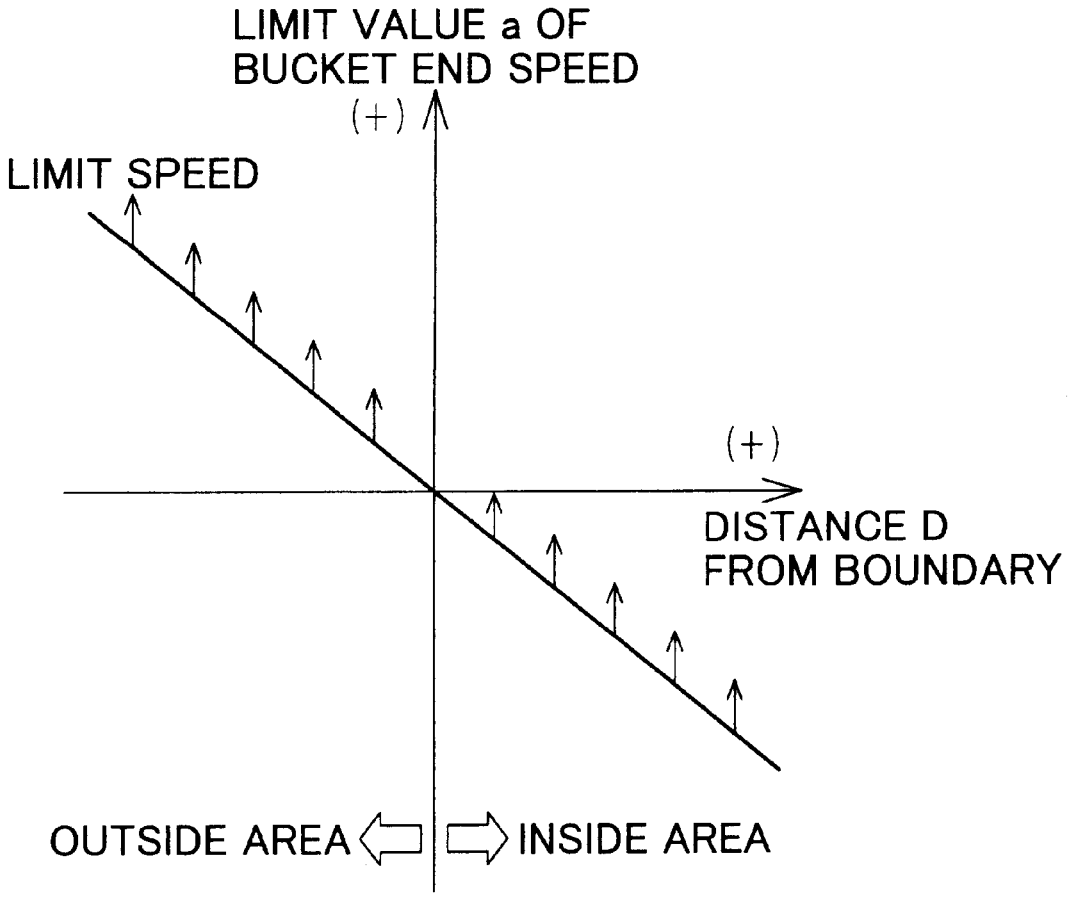
FIG. 7 is a graph showing the relationship between a distance to a bucket end from a boundary of the set area and a bucket end speed limit value, the relationship being used when the limit value is determined.

In FIG. 7, the horizontal axis represents the distance D to the bucket end from the boundary L of the set area, and the vertical axis represents the limit value a of the component of the bucket end speed vertical to the boundary L. As with the XaYa-coordinate system, the distance D on the horizontal axis and the speed limit value a on the vertical axis are each defined to be positive (+) in the direction toward the inside of the set area from the outside of the set area. The relationship between the distance D and the limit value a is set such that when the bucket end is inside the set area, a speed in the negative (−) direction proportional to the distance D is given as the limit value a of the component of the bucket end speed vertical to the boundary L, and when the bucket end is outside the set area, a speed in the positive (+) direction proportional to the distance D is given as the limit value a of the component of the bucket end speed vertical to the boundary L. Accordingly, inside the set area, the bucket end is slowed down only when the component of the bucket end speed vertical to the boundary L exceeds the limit value in the negative (−) direction, and outside the set area, the bucket end is sped up in the positive (+) direction.

The arm cylinder speed calculating portion 9d estimates an arm cylinder speed based on a command value (pilot pressure) applied to the flow control valve 5b for the arm, which is detected by the pressure sensor 61a, 61b, and the flow rate characteristic of the flow control valve 5b.

The arm-dependent bucket end speed calculating portion 9e calculates an arm-dependent bucket end speed b based on the arm cylinder speed and the position and posture of the front device 1A determined in the front posture calculating portion 9a.

The boom-dependent bucket end speed limit value calculating portion 9f transforms the arm-dependent bucket end speed b, which has been determined in the calculating portion 9e, from the XY-coordinate system to the XaYa-coordinate system by using the transform data determined in the area setting calculating portion 9b, calculates arm-dependent bucket end speeds ($b_x$, $b_y$), and then calculates a limit value c of the component of the boom-dependent bucket end speed vertical to the boundary L based on the limit value a of the component of the bucket end speed vertical to the boundary L determined in the calculating portion 9c and the component $b_y$ of the arm-dependent bucket end speed vertical to the boundary L. Such a process will now be described with reference to FIG. 8.

Figure 8:
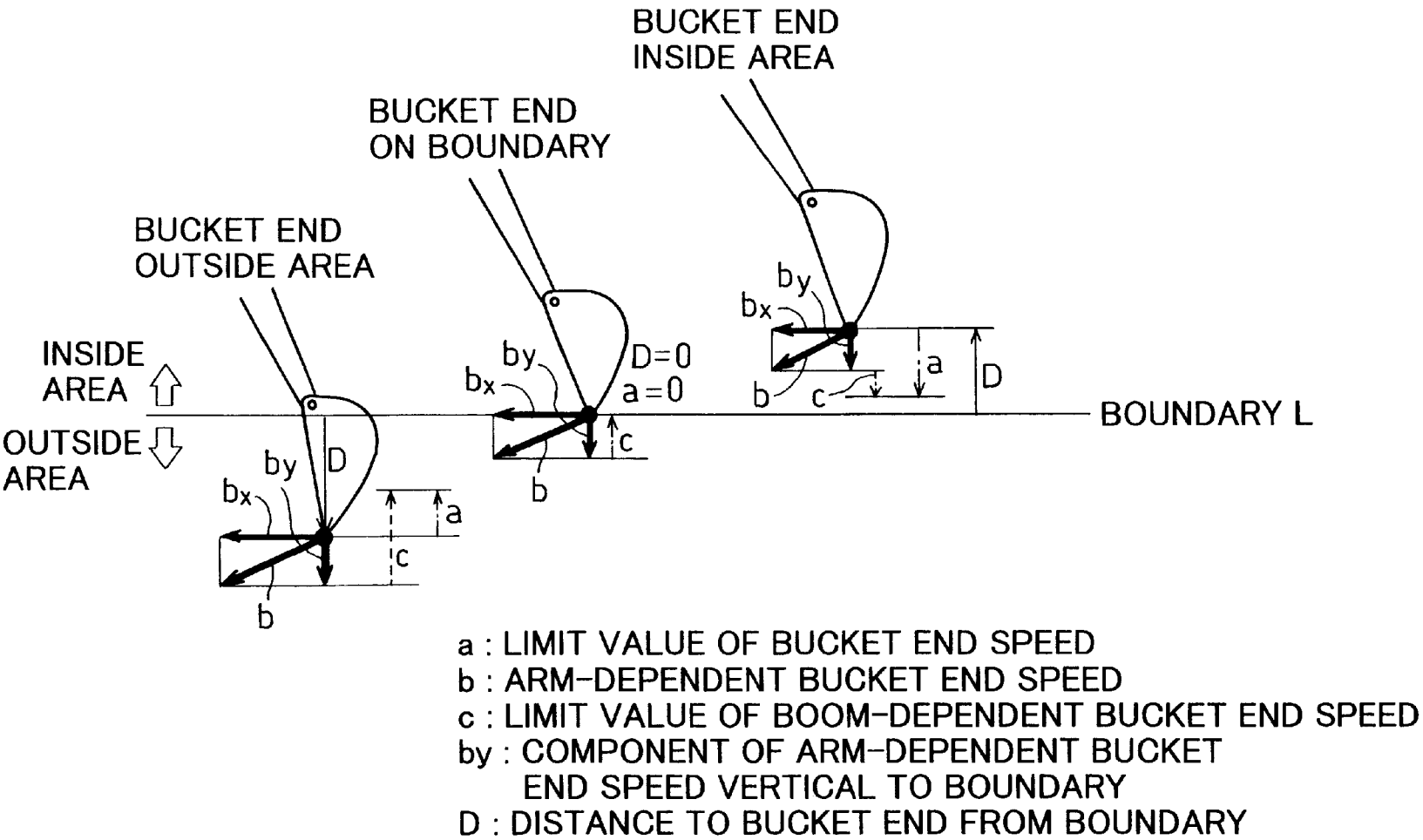
FIG. 8 is an illustrative view showing differences in operation of modifying a boom-dependent bucket end speed among the case of a bucket end positioned inside the set area, the case of the bucket end positioned on the set area, and the case of the bucket end positioned outside the set area.

In FIG. 8, the difference ($a-b_y$) between the limit value a of the component of the bucket end speed vertical to the boundary L determined in the bucket end speed limit value calculating portion 9c and the component $b_y$ of the arm-dependent bucket end speed b vertical to the boundary L determined in the arm-dependent bucket end speed calculating portion 9e provides a limit value c of the boom-dependent bucket end speed vertical to the boundary L. Then, the boom-dependent bucket end speed limit value calculating portion 9*f* calculates the limit value c from the formula of $c=a-b_y$.

The meaning of the limit value c will be described separately for the case where the bucket end is inside the set area, the case where the bucket end is on the boundary of the set area, and the case where the bucket end is outside the set area.

When the bucket end is inside the set area, the bucket end speed is restricted to the limit value a of the component of the bucket end speed vertical to the boundary L in proportion to the distance D to the bucket end from the boundary L and, therefore, the component of the boom-dependent bucket end speed vertical to the boundary L is restricted to c ($=a-b_y$). Thus, if the component $b_y$ of the bucket end speed b vertical to the boundary L exceeds c, the boom is slowed down to c.

When the bucket end is on the boundary L of the set area, the limit value a of the component of the bucket end speed vertical to the boundary L is set to 0, and the arm-dependent bucket end speed b toward the outside of the set area is cancelled out through the compensating operation of boom-up at the speed c. Thus, the component $b_y$ of the bucket end speed vertical to the boundary L becomes 0.

When the bucket end is outside the set area, the component of the bucket end speed vertical to the boundary L is restricted to the upward speed a in proportion to the distance D to the bucket end from the boundary L. Thus, the compensating operation of boom-up at the speed c is always performed so that the bucket end is restored to the inside of the set area.

The boom cylinder speed limit value calculating portion 9*g* calculates a limit value of the boom cylinder speed through the coordinate transformation using the aforesaid transform data based on the limit value c of the component of the boom-dependent bucket end speed vertical to the boundary L and the position and posture of the front device 1A.

The boom pilot pressure limit value calculating portion 9*h* determines, based on the flow rate characteristic of the flow control valve 5*a* for the boom, a limit value of the boom pilot pressure (boom command) corresponding to the limit value of the boom cylinder speed determined in the calculating portion 9*g*.

The area limiting control changeover calculating portion 9*r* outputs, as the limit value of the boom pilot pressure, the value calculated in the calculating portion 9*h* as it is when the area limiting switch 7*d*1 is turned on (pushed) and the area limiting excavation control is selected, and outputs, as the limit value of the boom pilot pressure, a maximum value when the area limiting switch 7*d*1 is turned off (not pushed) and the area limiting excavation control is not selected.

The boom command calculating portion 9*i* receives the limit value of the pilot pressure from the calculating portion 9*r* and when the received limit value is positive, it outputs a voltage corresponding to the limit value to the proportional solenoid valve 10*a* on the boom-up side, thereby restricting the pilot pressure imposed on the hydraulic driving sector 50*a* of the flow control valve 5*a* to that limit value, and outputs a voltage of 0 to the proportional solenoid valve 10*b* on the boom-down side, thereby making zero (0) the pilot pressure imposed on the hydraulic driving sector 50*b* of the flow control valve 5*a*. When the received limit value is negative, the boom command calculating portion 9*i* outputs a voltage corresponding to the limit value to the proportional solenoid valve 10*b* on the boom-down side, thereby restricting the pilot pressure imposed on the hydraulic driving sector 50*b* of the flow control valve 5*a* to that limit value, and outputs a voltage of 0 to the proportional solenoid valve 10*a* on the boom-up side, thereby making nil (0) the pilot pressure imposed on the hydraulic driving sector 50*a* of the flow control valve 5*a*.

The display changeover control calculating portion 9*s* indicates the position of the bucket end $P_1$ calculated in the front posture calculating portion 9*a* in numeral value when the setting changeover switch 7*c*1 is turned off (not pushed) and the numeral input setting is not selected, and indicates the position designated by the numeral input setting when the setting changeover switch 7*c*1 is turned on (pushed) and the numeral input setting is not selected.

The operation of this embodiment having the above-explained arrangement will be described below in connection with the case where the area limiting switch 7*d*1 is turned on and the area limiting excavation control is performed. The following description will be made on several work examples; i,e., the case of operating the control lever of the boom control lever unit 4*a* in the boom-down direction to lower the boom with the intention of positioning the bucket end (i.e., the boom-down operation), and the case of operating the control lever of the arm control lever unit 4*b* in the arm-crowding direction to crowd the arm with the intention of digging the ground toward the body (i.e., the arm crowding operation).

When the control lever of the boom control lever unit 4*a* is operated in the boom-down direction with the intention of positioning the bucket end, a pilot pressure representative of the command value from the control lever unit 4*a* is applied to the hydraulic driving sector 50*b* of the flow control valve 5*a* on the boom-down side through the pilot line 44*b*. At the same time, the bucket end speed limit value calculating portion 9*c* calculates, based on the relationship shown in FIG. 7, a limit value a (<0) of the bucket end speed in proportion to the distance D to the bucket end from the boundary L of the set area, the boom-dependent bucket end speed limit value calculating portion 9*f* calculates a limit value c=a (<0) of the boom-dependent bucket end speed, and the boom pilot pressure limit value calculating portion 9*h* calculates a negative limit value of the boom pilot pressure corresponding to the limit value c. Then, the boom command calculating portion 9*i* outputs a voltage corresponding to the calculated limit value to the proportional solenoid valve 10*b*, thereby restricting the pilot pressure applied to the hydraulic driving sector 50*b* of the flow control valve 5*a* on the boom-down side, and also outputs a voltage of 0 to the proportional solenoid valve 10*a* for making nil (0) the pilot pressure applied to the hydraulic driving sector 50*a* of the flow control valve 5*a* on the boom-up side. Here, when the bucket end is far away from the boundary L of the set area, the limit value of the boom pilot pressure determined in the calculating portion 9*h* has an absolute value greater than that of the pilot pressure from the control lever unit 4*a*, and therefore the proportional solenoid valve 10*b* outputs the pilot pressure from the control lever unit 4*a* as it is. Accordingly, the boom is gradually moved down depending on the pilot pressure from the control lever unit 4*a*.

As the boom is gradually moved down and the bucket end comes closer to the boundary L of the set area as mentioned above, the limit value c=a (<0) of the boom-dependent bucket end speed calculated in the calculating portion 9*f* is increased (its absolute value |a| or |c| is reduced) and an absolute value of the corresponding boom command limit value (<0) calculated in the calculating portion 9*h* is reduced. Then, when the absolute value of the limit value becomes smaller than the command value from the control lever unit 4*a* and the voltage output to the proportional solenoid valve 10*b* from the boom command calculating portion 9*i* is reduced correspondingly, the proportional solenoid valve 10*b* reduces and then outputs the pilot pressure from the control lever unit 4*a* for gradually restricting the pilot pressure applied to the hydraulic driving sector 50*b* of the flow control valve 5*a* on the boom-down side depending on the limit value c. Thus, the boom-down speed is gradually restricted as the bucket end comes closer to the boundary L of the set area, and the boom is stopped when the bucket end reaches the boundary L of the set area. As a result, the bucket end can be easily and smoothly positioned.

When the bucket end has moved out beyond the boundary L of the set area, the limit value a (=c) of the bucket end speed in proportion to the distance D to the bucket end from the boundary L of the set area is calculated as a positive value in the calculating portion 9*c* based on the relationship shown in FIG. 7, and the boom command calculating portion 9*i* outputs a voltage corresponding to the limit value c to the proportional solenoid valve 10*a* for applying a pilot pressure corresponding to the limit value a to the hydraulic driving sector 50*a* of the flow control valve 5*a* on the boom-up side. The boom is thereby moved in the boom-up direction at a speed proportional to the distance D for restoration toward the inside of the set area, and then stopped when the bucket end is returned to the boundary L of the set area. As a result, the bucket end can be more smoothly positioned.

Further, when the control lever of the arm control lever unit 4*b* is operated in the arm-crowding direction with the intention of digging the ground toward the body, a pilot pressure representative of the command value from the control lever unit 4*b* is applied to the hydraulic driving sector 51*a* of the flow control valve 5*b* on the arm-crowding side, causing the arm to be moved down toward the body. At the same time, the pilot pressure from the control lever unit 4*b* is detected by the pressure sensor 61*a* and input to the calculating portion 9*d* which calculates an arm cylinder speed. Then, the calculating portion 9*e* calculates an arm-dependent bucket end speed b. On the other hand, the calculating portion 9*c* calculates, based on the relationship shown in FIG. 7, a limit value a (<0) of the bucket end speed in proportion to the distance D to the bucket end from the boundary L of the set area, and the calculating portion 9*f* calculates a limit value $c=a-b_y$ of the boom-dependent bucket end speed. Here, when the bucket end is so far away from the boundary L of the set area as to meet the relationship of $a<b_y$ ($|a|>|b_y|$) the limit value c is calculated as a negative value in the calculating portion 9*f*. Therefore, the boom command calculating portion 9*i* outputs a voltage corresponding to the calculated limit value to the proportional solenoid valve 10*b*, thereby restricting the pilot pressure applied to the hydraulic driving sector 50*b* of the flow control value 5*a* on the boom-down side, and also outputs a voltage of 0 to the proportional solenoid valve 10*a* for making nil (0) the pilot pressure applied to the hydraulic driving sector 50*a* of the flow control valve 5*a* on the boom-up side. At this time, since the control lever unit 4*a* is not operated, no pilot pressure is applied to the hydraulic driving sector 50*b* of the flow control valve 5*a*. As a result, the arm is gradually moved toward the body depending on the pilot pressure from the control lever unit 4*b*.

Figure 9:
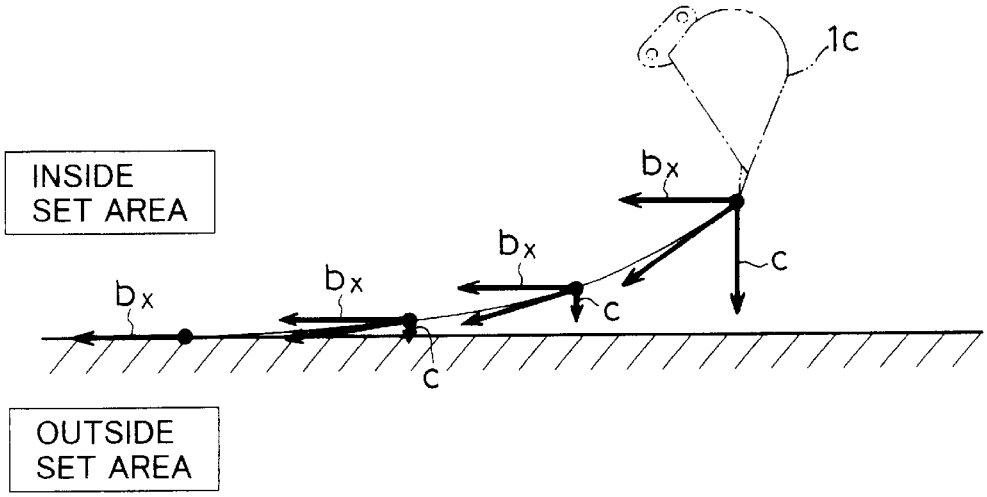
FIG. 9 is an illustrative view showing one example of a locus along which the bucket end is moved under modified operation when it is inside the set area.

As the arm is gradually moved toward the body and the bucket end comes closer to the boundary L of the set area as mentioned above, the limit value a of the bucket end speed calculated in the calculating portion 9*c* is increased (its absolute value |a| is reduced). Then, when the limit value a becomes greater than the component $b_y$ of the arm-dependent bucket end speed b vertical to the boundary L calculated in the calculating portion 9*e*, the limit value $c=a-b_y$ of the boom-dependent bucket end speed is calculated as a positive value in the calculating portion 9*f*. Therefore, the boom command calculating portion 9*i* outputs a voltage corresponding to the limit value c to the proportional solenoid valve 10*a* on the boom-up side, thereby restricting the pilot pressure applied to the hydraulic driving sector 50*a* of the flow control valve 5*a* to that limit value, and also outputs a voltage of 0 to the proportional solenoid valve 10*b* on the boom-down side for making nil (0) the pilot pressure applied to the hydraulic driving sector 50*b* of the flow control valve 5*a*. Accordingly, the boom-up operation for modifying the bucket end speed is performed such that the component of the bucket end speed vertical to the boundary L is gradually restricted in proportion to the distance D to the bucket end from the boundary L. Thus, direction change control is carried out with a resultant of the unmodified component $b_x$ of the arm-dependent bucket end speed parallel to the boundary L and the speed component vertical to the boundary L modified depending on the limit value c, as shown in FIG. 9, enabling the excavation to be performed along the boundary L of the set area.

Figure 10:
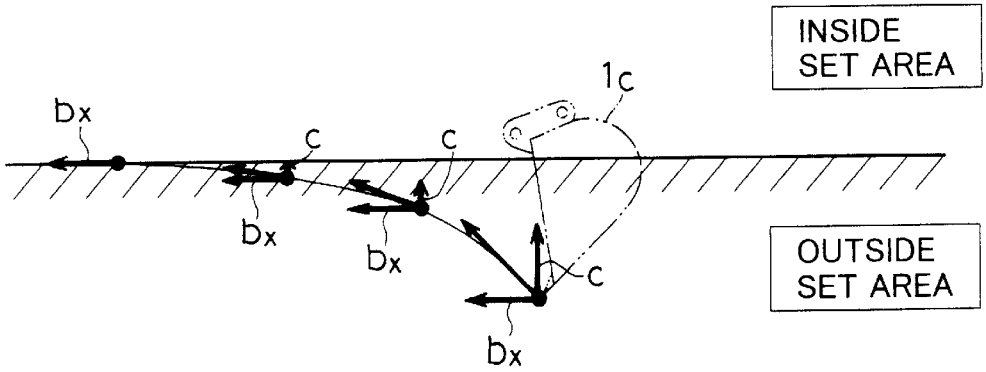
FIG. 10 is an illustrative view showing one example of a locus along which the bucket end is moved under modified operation when it is outside the set area.

Further, when the bucket end has moved out beyond the boundary L of the set area, the limit value a of the bucket end speed in proportion to the distance D to the bucket end from the boundary L of the set area is calculated as a positive value in the calculating portion 9*c* based on the relationship shown in FIG. 7, the limit value $c=a-b_y$ (>0) of the boom-dependent bucket end speed calculated in the calculating portion 9*f* is increased in proportion to the limit value a, and the voltage output from the boom command calculating portion 9*i* to the proportional solenoid valve 10*a* on the boom-up side is increased depending on the limit value c. In the case of the bucket end having moved out of the set area, therefore, the boom-up operation for modifying the bucket end speed is performed so that the bucket end is restored toward the inside of the set area at a speed proportional to the distance D. Thus, the excavation is carried out with a resultant of the unmodified component $b_x$ of the arm-dependent bucket end speed parallel to the boundary L and the speed component vertical to the boundary L modified depending on the limit value c, while the bucket end is gradually returned to and moved along the boundary L of the set area as shown in FIG. 10. Consequently, the excavation can be smoothly performed along the boundary L of the set area just by crowding the arm.

With this embodiment, as described above, when the bucket end is inside the set area, the component of the bucket end speed vertical to the boundary L of the set area is restricted in accordance with the limit value a in proportion to the distance D to the bucket end from the boundary L of the set area. Therefore, in the boom-down operation, the bucket end can be easily and smoothly positioned, and in the arm crowding operation, the bucket end can be moved along the boundary L of the set area. This enables the excavation to be efficiently and smoothly performed within a limited area.

When the bucket end is outside the set area, the front device is controlled to return to the set area in accordance with the limit value a in proportion to the distance D to the bucket end from the boundary L of the set area. Therefore, even when the front device is moved quickly, the front device can be moved along the boundary L of the set area and the excavation can be precisely performed within a limited area.

Further, since the bucket end is slowed down under the direction change control before reaching the boundary of the set area as described above, an amount by which the bucket end projects out of the set area is reduced and a shock caused upon the bucket end returning to the set area is greatly alleviated. Therefore, even when the front device is moved quickly, the front device can be smoothly moved back to the set area and the excavation can be smoothly performed within a limited area.

Additionally, since this embodiment includes, as means for setting the excavation area in the area limiting excavation control, both area setting means adapted for the direct teaching setting and the numeral input setting, the operator can select optimum area setting means in any of work sites, take prompt actions for various types of works, and implement excavation work in an appropriate and expeditious manner.

For example, when the ground should be generally leveled by rough excavation in the work site where an area to be excavated is not especially defined by numerals put on the drawing or the like, the excavation area can be speedily set with the above function (a) of the direct teaching setting by placing the bucket end directly to a target position for excavation and pushing the direct setting switch 7*a*.

In some work sites, however, the depth by which the ground is to be excavated from the level of a hydraulic excavator on the ground surface is specified in unit of meter. In such a case, by pushing the setting changeover switch 7*c*1 and inputting the specified depth through the numeral input switch 7*b*, a desired excavation area can be promptly set with the above function (b) of numeral input setting) and the excavation work can be performed under optimum control.

Further, work of gradually proceeding with excavation from the ground surface and digging up a pipe (water service pipe or the like) buried in earth is performed by first roughly excavating the earth to some extent without any control, then setting the position reached at that time by the direct teaching, and then setting a greater depth step by step by inputting numeral values with that position as a base in accordance with the above setting function (c). This makes it possible to excavate the ground roughly quickly to some extent without any control, and thereafter to proceed with the excavation gradually in steps of several centimeters in such a manner as like carefully peeling off a thin skin, thus quickly digging up the target pipe without damaging it.

Also, since the setting changeover switch 7*c*1 is pushed only when the numeral input setting is to be made through the numeral input switch 7*b*, the operator is just required to push the direct setting switch 7*a* when trying to make the direct teaching setting. Therefore, the setting changeover can be rationally achieved with a minimum switching operation and the area setting can be performed with priority given to the direct teaching setting.

Moreover, when the setting changeover switch 7*c*1 is not pushed, the current position of the bucket end of the front device 1*a* is indicated on the display screen 7*e*, and when the setting changeover switch 7*c*1 is pushed, the setting mode is changed over and the numeral value input from the numeral input switch 7*b* is indicated on the display screen 7*e*. During the area limiting excavation control and the direct teaching setting, therefore, the operator can perform work while confirming the current position of the bucket end of the front device 1*a* on the display screen 7*e*. During the numeral input setting, the operator can proceed with the setting while looking at the numeral value input from the numeral input switch 7*b* on the display screen 7*e*.

In addition, whenever the area limiting excavation control is selected by pushing the area limiting switch 7*d*1, a value representing a position to which the front device cannot reach (−20 m in the above example) is set as the initial value of the excavation area. This enables the front device to freely move over a full range where it is inherently operable, for free setting of the excavation area within that full operable range.

A second embodiment of the present invention will be described with reference to FIGS. 11 and 12. In this embodiment, the present invention is applied to a hydraulic excavator employing electric control lever units.

Figure 11:
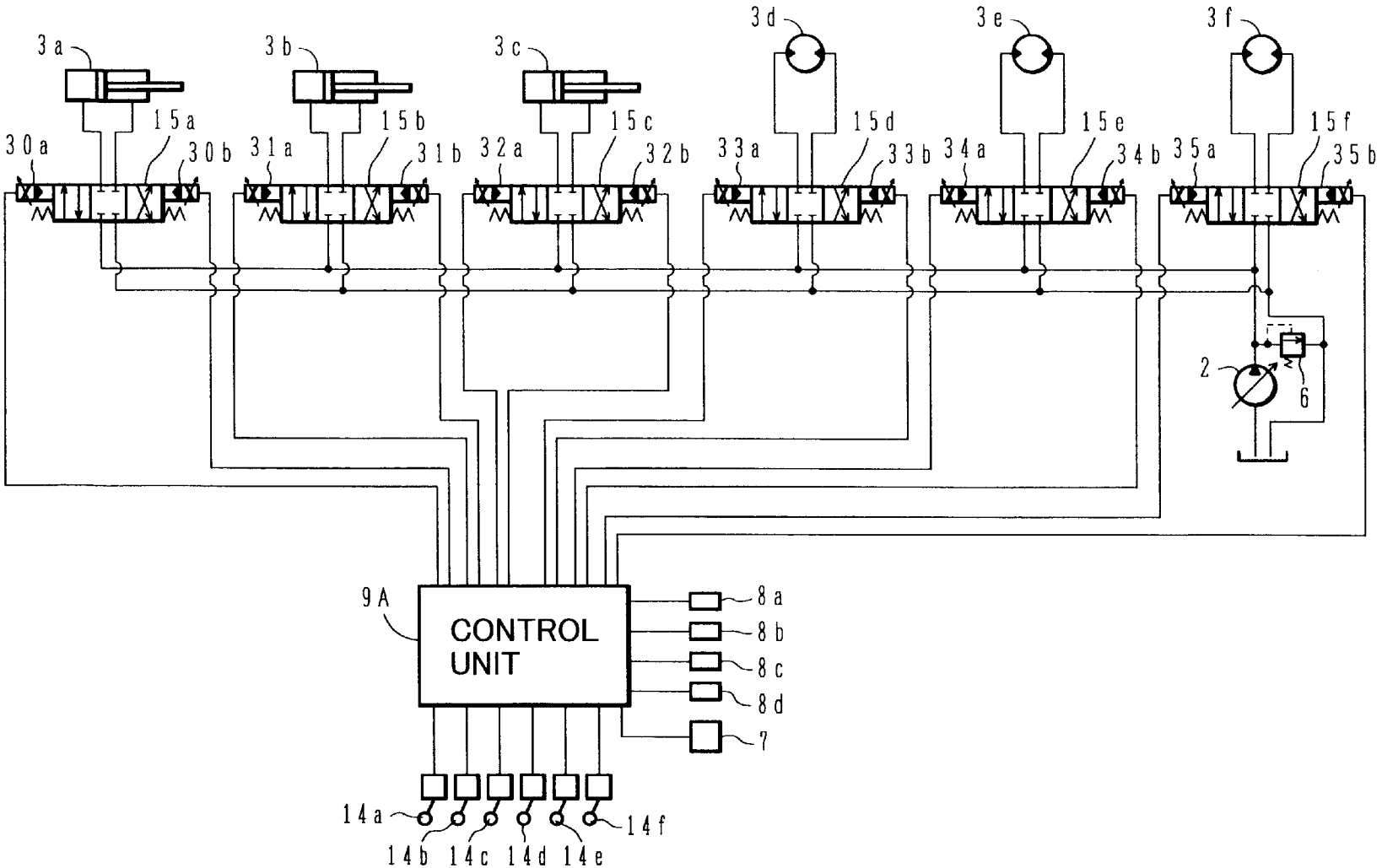
FIG. 11 is a diagram showing a front control system for a construction machine according to a second embodiment of the present invention, along with a hydraulic drive system thereof.

Referring to FIG. 11, a hydraulic excavator in which this embodiment is realized includes electric control lever units 14*a*–14*f* instead of the foregoing control lever units 4*a*–4*f* of pilot hydraulic type. The control lever units 14*a*–14*f* each output, as an electric signal, a voltage depending on the input amount and the direction by and in which their control levers are each manipulated by the operator, and supply the electric signal to corresponding one of electro-hydraulic converting means, e.g., solenoid driving sectors 30*a*, 30*b*–35*a*, 35*b* including proportional solenoid valves, provided at opposite ends of the flow control valves 15*a*–15*f* through a control unit 9A.

A setting device 7 is the same as that used in the first embodiment shown in FIG. 3.

Figure 12:
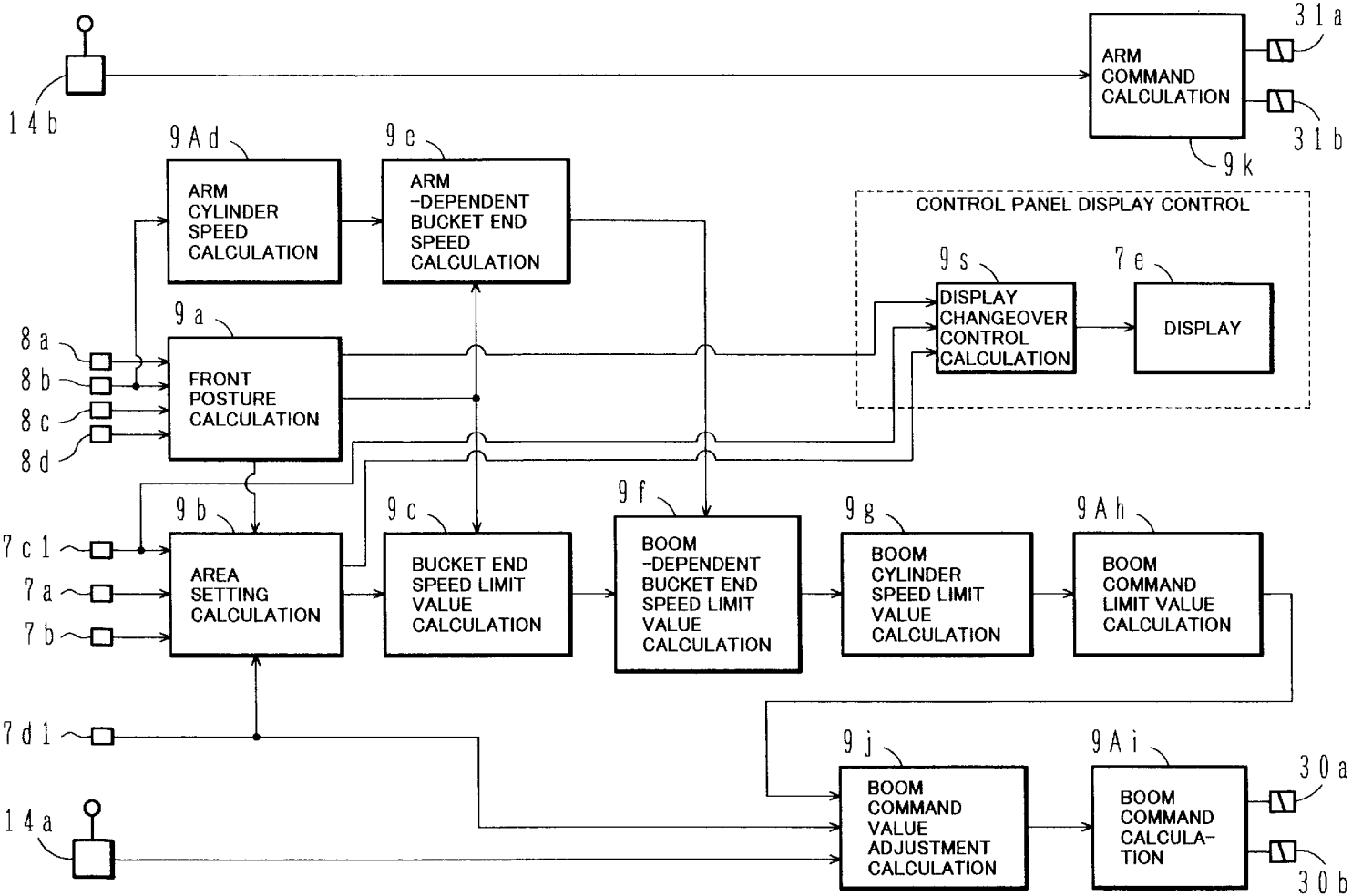
FIG. 12 is a block diagram showing control functions of a control unit.

FIG. 12 shows control functions of the control unit 9A. The control unit 9A includes various functions executed by a front posture calculating portion 9*a*, an area setting calculating portion 9*b*, a bucket end speed limit value calculating portion 9*c*, an arm cylinder speed calculating portion 9A*d*, an arm-dependent bucket end speed calculating portion 9*e*, a boom-dependent bucket end speed limit value calculating portion 9*f*, a boom cylinder speed limit value calculating portion 9*g*, a boom command limit value calculating portion 9A*h*, a boom command adjustment calculating portion 9*j*, a boom command calculating portion 9A*i*, an arm command calculating portion 9*k*, and a display changeover control calculating portion 9*s*.

The arm cylinder speed calculating portion 9A*d* determines a displacement of the arm cylinder through coordinate transformation based on the arm rotational angle detected by the angle sensor 8*b*, and differentiates the displacement, thereby directly deriving an arm cylinder speed. As an alternative, the arm cylinder speed may be derived by using the operation signal from the arm control lever unit 4*b*.

The boom command limit value calculating portion 9A*h* determines, based on the flow rate characteristic of the flow control valve 15*a* for the boom, a limit value of the boom command corresponding to the limit value of the boom cylinder speed determined in the calculating portion 9*g*.

The boom command adjustment calculating portion 9*j* compares the limit value of the boom command determined in the calculating portion 9A*h* with the command value from the control lever unit 14*a* and then outputs a larger one when the area limiting switch 7*d*1 of the setting device 7 (see FIG. 3) is turned on (pushed) and the area limiting excavation control is selected, and it outputs the command value from the control lever unit 14*a* when the area limiting switch 7*d*1 is turned off (not pushed) and the area limiting excavation control is not selected. Here, as with the XaYa-coordinate system, the command value from the control lever unit 14*a* is defined to be positive (+) in the direction toward the inside of the set area from the outside of the set area (i.e., in the boom-up direction). Also, that the calculating portion 9*j* outputs larger one of the limit value of the boom command and the command value from the control lever unit 14*a* means that it outputs a smaller one of absolute values of both the above values because the limit value c is negative (−) when the bucket end is inside the set area, and it outputs a larger one of absolute values of both the above values because the limit value c is positive (+) when the bucket end is outside the set area.

The boom command calculating portion 9A*i* receives the command value from the boom command adjustment calculating portion 9*j*. When the received command value is positive, the calculating portion 9A*i* outputs a corresponding voltage to the boom-up solenoid driving sector 30*a* of the flow control valve 15*a* and a voltage of 0 to the boom-down solenoid driving sector 30*b* thereof. When the received command value is negative, the calculating portion 9A*i* outputs voltages in a reversed manner to the above.

The arm command calculating portion 9*k* receives the command value from the control lever unit 14*b*. When the received command value is positive, the calculating portion 9A*i* outputs a corresponding voltage to the arm-crowding solenoid driving sector 31*a* of the flow control valve 15*b* and a voltage of 0 to the arm-dumping solenoid driving sector 31*b* thereof. When the received command value is negative, the calculating portion 9*k* outputs voltages in a reversed manner to the above.

Likewise, though not shown, valve command calculating portions are provided to receive respective command values from the control lever units 14*c*–14*f* and output voltages corresponding to the received command values to the solenoid driving sectors of the associated flow control valves.

The other functions are the same as those in the first embodiment.

This embodiment thus constructed operates as follows. When the control lever of the boom control lever unit 14*a* is operated in the boom-down direction with the intention of positioning the bucket end, the command value from the control lever unit 14*a* is input to the boom command value adjustment calculating portion 9*j*. At the same time, the bucket end speed limit value calculating portion 9*c* calculates, based on the relationship shown in FIG. 7, a limit value a (<0) of the bucket end speed in proportion to the distance D to the bucket end from the boundary L of the set area, the boom-dependent bucket end speed limit value calculating portion 9*f* calculates a limit value c=a (<0) of the boom-dependent bucket end speed, and the boom command limit value calculating portion 9A*h* calculates a negative limit value of the boom command corresponding to the limit value c. Here, when the bucket end is far away from the boundary L of the set area, the limit value of the boom command determined in the calculating portion 9A*h* is greater than the command value from the control lever unit 14*a*, and therefore the boom command value adjustment calculating portion 9*j* selects the command value from the control lever unit 14*a*. Since the selected command value is negative, the boom command calculating portion 9A*i* outputs a corresponding voltage to the boom-down solenoid driving sector 30*b* of the flow control valve 15*a*, and a voltage of 0 to the boom-up solenoid driving sector 30*a* thereof. As a result, the boom is gradually moved down in accordance with the command value from the control lever unit 14*a*.

As the boom is gradually moved down and the bucket end comes closer to the boundary L of the set area as mentioned above, the limit value c=a (<0) of the boom-dependent bucket end speed calculated in the calculating portion 9*f* is increased (its absolute value |a| or |c| is reduced). Then, when the corresponding boom command limit value determined in the calculating portion 9A*h* becomes greater than the command value from the control lever unit 14*a*, the boom command value adjustment calculating portion 9*j* selects the former limit value and the boom command calculating portion 9A*i* gradually restricts the voltage output to the boom-down solenoid driving sector 30*b* of the flow control valve 15*a* depending on the limit value c. Accordingly, the boom-down speed is gradually restricted as the bucket end comes closer to the boundary L of the set area, and the boom is stopped when the bucket end reaches the boundary L of the set area. As a result, the bucket end can be easily and smoothly positioned.

Because of the above modifying process being carried out as speed control, if the speed of the front device 1A is extremely large, or if the control lever unit 14*a* is abruptly manipulated, the bucket end may go out beyond the boundary L of the set area due to a response delay in the control process, e.g., a delay in the hydraulic circuit, inertial force imposed upon the front device 1A, and so on. When the bucket end has moved out beyond the boundary L of the set area, the limit value a (=c) of the bucket end speed in proportion to the distance D to the bucket end from the boundary L of the set area is calculated as a positive value in the calculating portion 9*c* based on the relationship shown in FIG. 7, and the boom command calculating portion 9A*i* outputs a voltage corresponding to the limit value c to the boom-up solenoid driving sector 30*a* of the flow control valve 15*a*. The boom is thereby moved in the boom-up direction at a speed proportional to the distance D for restoration toward the inside of the set area, and then stopped when the bucket end is returned to the boundary L of the set area. As a result, the bucket end can be more smoothly positioned.

Further, when the control lever of the arm control lever unit 14*b* is operated in the arm-crowding direction with the intention of digging the ground toward the body, the command value from the control lever unit 14*b* is input to the arm command calculating portion 9*k* which outputs a corresponding voltage to the arm-crowding solenoid driving sector 31*a* of the flow control valve 15*b*, causing the arm to be moved down toward the body. At the same time, the command value from the control lever unit 14*b* is also input to the arm cylinder speed calculating portion 9A*d* which calculates an arm cylinder speed. Then, the arm-dependent bucket end speed calculating portion 9*e* calculates an arm-dependent bucket end speed b. On the other hand, the bucket end speed limit value calculating portion 9*c* calculates, based on the relationship shown in FIG. 7, a limit value a (<0) of the bucket end speed in proportion to the distance D to the bucket end from the boundary L of the set area, and the boom-dependent bucket end speed limit value calculating portion 9*f* calculates a limit value $c=a-b_y$ of the boom-dependent bucket end speed. Here, when the bucket end is so far away from the boundary L of the set area as to meet the relationship of $a<b_y$ ($|a|>|b_y|$) the limit value c is calculated as a negative value in the calculating portion 9*f*. Therefore, the boom command value adjustment calculating portion 9*j* selects the command value (=0) from the control lever unit 14*a* and the boom command calculating portion 9A*i* outputs a voltage of 0 to both the boom-up solenoid driving sector 30*a* and the boom-down solenoid driving sector 30*b* of the flow control valve 15*a*. The arm is thereby moved toward the body depending on the command value from the control lever unit 14*b*.

As the arm is gradually moved toward the body and the bucket end comes closer to the boundary L of the set area as mentioned above, the limit value a of the bucket end speed calculated in the calculating portion 9*c* is increased (its absolute value |a| is reduced). Then, when the limit value a becomes greater than the component $b_y$ of the arm-dependent bucket end speed b vertical to the boundary L calculated in the calculating portion 9*e*, the limit value $c=a-b_y$ of the boom-dependent bucket end speed is calculated as a positive value in the calculating portion 9*f*. Therefore, the boom command value adjustment calculating portion 9*j* selects the limit value calculated in the calculating portion 9A*h*, and the boom command calculating portion 9A*i* outputs a voltage corresponding to the limit value c to the boom-up solenoid driving sector 30*a* of the flow control valve 15*a*. Thus, the bucket end speed is modified with the boom-up operation so that the component of the bucket end speed vertical to the boundary L is gradually restricted in proportion to the distance D to the bucket end from the boundary L. Accordingly, direction change control is carried out with a resultant of the unmodified component $b_x$ of the arm-dependent bucket end speed parallel to the boundary L and the speed component vertical to the boundary L modified depending on the limit value c, as shown in FIG. 9, enabling the excavation to be performed along the boundary L of the set area.

Also, in this case, the bucket end may go out beyond the boundary L of the set area for the same reasons as mentioned above. When the bucket end has moved out beyond the boundary L of the set area, the limit value a of the bucket end speed in proportion to the distance D to the bucket end from the boundary L of the set area is calculated as a positive value in the calculating portion 9*c* based on the relationship shown in FIG. 7, the limit value $c=a-b_y$ (>0) of the boom-dependent bucket end speed calculated in the calculating portion 9*f* is increased in proportion to the limit value a, and the voltage output from the boom command calculating portion 9A*i* to the boom-up solenoid driving sector 30*a* of the flow control valve 15*a* is increased depending on the limit value c. In the case of the bucket end having moved out of the set area, therefore, the boom-up operation for modifying the bucket end speed is performed so that the bucket end is restored toward the inside of the set area at a bucket end speed proportional to the distance D. Thus, the excavation is carried out under a resultant of the unmodified component $b_x$ of the arm-dependent bucket end speed parallel to the boundary L and the speed component vertical to the boundary L modified depending on the limit value c, enabling the excavation to be performed while the bucket end is gradually returned to and moved along the boundary L of the set area as shown in FIG. 10. Consequently, the excavation can be smoothly performed along the boundary L of the set area just by crowding the arm.

With this embodiment, as described above, the area limiting excavation control can be similarly performed to the first embodiment in the control system employing electric control lever units.

Also, similar advantages as with the first embodiment can also be obtained when the excavation area is set with the setting device 7 and the area setting calculating portion 9*b*.

In the foregoing embodiments, the area limiting excavation control is started based on the initial value of the excavation area as soon as the area limiting switch 7*d*1 of the setting device 7 is pushed. However, the area limiting excavation control may be started only after the direct teaching setting or the numeral input setting is made.

Figure 13:
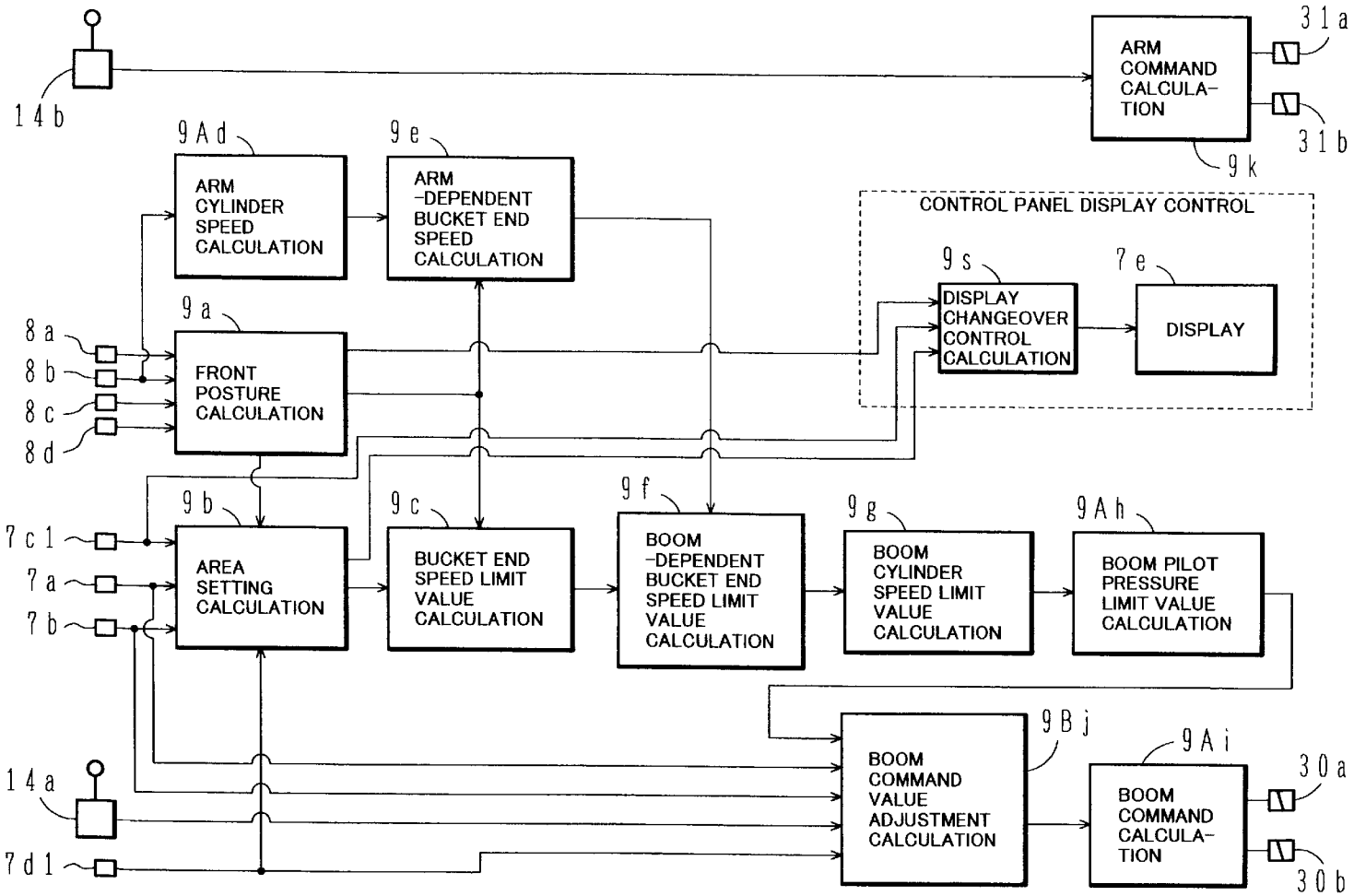
FIG. 13 is a block diagram showing control functions of the control unit for explaining, as a third embodiment, a modification of the second embodiment of the present invention.

FIG. 13 shows, as a third embodiment of the present invention, such a modification. FIG. 13 corresponds to FIG. 12 representing the second embodiment. A boom command adjustment calculating portion $9B_j$ outputs the command value from the control lever unit 14*a* when the area limiting switch 7*d*1 is turned off (not pushed) and the area limiting excavation control is not selected. Even when the area limiting switch 7*d*1 is turned on (pushed) and the area limiting excavation control is selected, the calculating portion $9B_j$ also outputs the command value from the control lever unit 14*a* if the direct setting switch 7*a* and the numeral value input switch 7*b* are not yet pushed. Then, if any one of the direct setting switch 7*a* and the numeral value input switch 7*b* is pushed and the excavation area is set in the condition where the area limiting switch 7*d*1 is turned on (pushed) and the area limiting excavation control is selected, the calculating portion $9B_j$ compares the limit value of the boom command determined in the calculating portion 9A*h* with the command value from the control lever unit 14*a* and then outputs larger one.

In the foregoing embodiments, when the area limiting switch 7*d*1 of the setting device 7 is turned off to bring the area limiting excavation control to an end, the excavation are always reset to the initial value Y=−20 m. However, the control unit 9 may store the values set until that time and start the control process from the previous set value of the excavation area when the control process is resumed subsequently.

Figure 14:
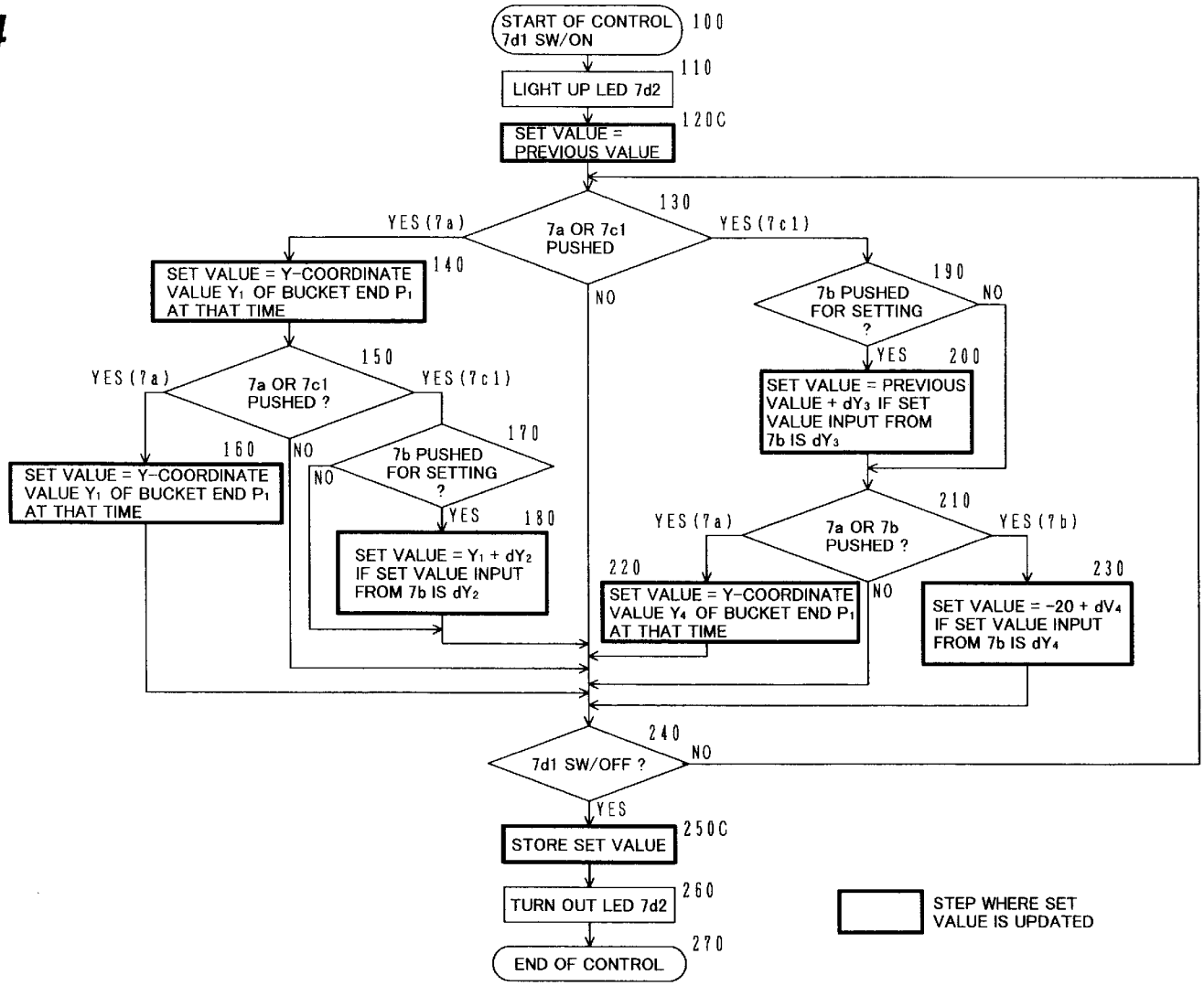
FIG. 14 is a flowchart showing processing steps executed in an area setting calculation portion, for explaining another modified (fourth) embodiment of the present invention.

FIG. 14 shows, as a fourth embodiment of the present invention, such a modification. FIG. 14 corresponds to FIG. 6 representing the first embodiment. After the area limiting switch 7*d*1 is turned off in step 240, the value set up to that time is stored in step 250C for each control process. Then, when the next control process is started, the previous set value is used as a set value of the excavation area in step 120C.

In the foregoing embodiments, the value set by the direct teaching is used as the base value from which the value input by the numeral input setting is increased or reduced. However, the base value from which the value input by the numeral input setting is increased or reduced may be always held constant (e.g., at a fixed base value of Y=0).

Figure 15:
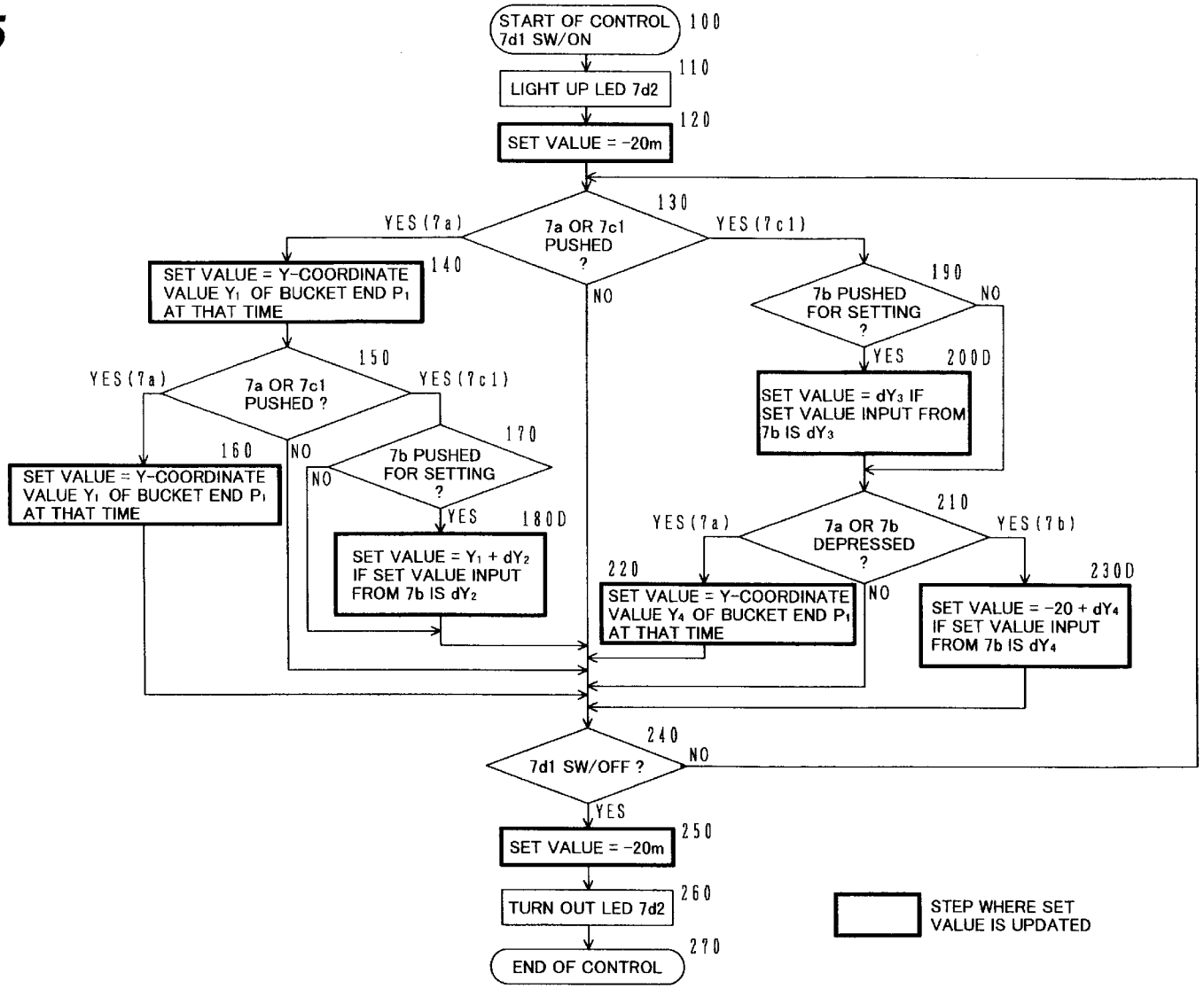
FIG. 15 is a flowchart showing processing steps executed in an area setting calculation portion, for explaining still another modified embodiment of the present invention.

FIG. 15 shows, as a fifth embodiment of the present invention, such a modification. FIG. 15 also corresponds to FIG. 6 representing the first embodiment. Changes input by the numeral input setting are directly set as set values=dY2, dY3, dY4, respectively, in steps 180D, 200D, 230D.

Alternatively, the base value from which the value input by the numeral input setting is increased or reduced may be set to the height of the pivot point of the boom 1*a* from the ground surface. This case is advantageous in that the value input by the numeral input setting provides a depth from the ground surface.

Another example of the setting device for use in the front control system will be described, as a sixth embodiment of the present invention, with reference to FIG. 16.

Figure 16:
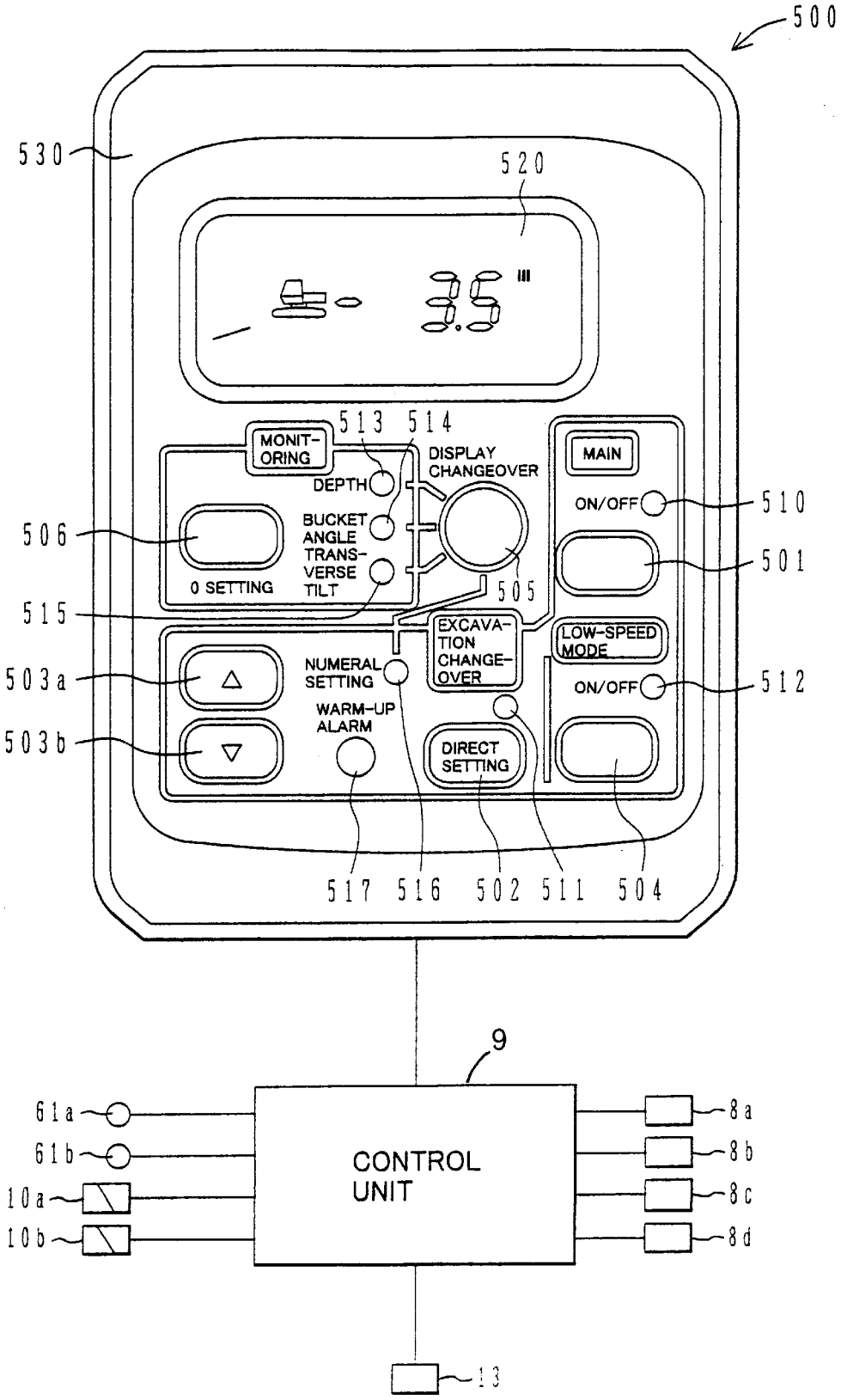
FIG. 16 is an illustrative view showing, as a sixth embodiment, another example of the setting device in the front control system of the present invention.

In FIG. 16, denoted by 500 is a box-type control panel constituting the setting device. The control panel 500 has various switches such as a main switch 501, a direct setting switch 502, an up-switch 503*a* and a down-switch 503*b* for the numeral input setting, a low-speed mode switch 504, a display changeover switch 505 and a 0-setting switch 506, various LED's 510→516 associated with these switches, a warm-up alarm lamp 517, and a liquid crystal display screen 520. These components are mounted on a panel body 530.

The main switch 501 is to select whether the area limiting excavation control according to the present invention is started or not, and corresponds to the area limiting switch 7*d*1 shown in FIG. 3. When the main switch 501 is pushed (turned on), a control start signal instructing changeover from a normal mode to an area limiting excavation control is output to the control unit 9, thus making it possible to perform, e.g., the setting of the excavation area and the area limiting excavation control described in connection with the first embodiment. At the same time, the LED 510 is lit up to inform the operator of that the area limiting excavation control mode is now selected.

The direct setting switch 502 is to set an excavation area by the direct teaching and corresponds to the direct setting switch 7*a* shown in FIG. 3. When the switch 502 is pushed, a direct teaching setting signal is output to the control unit 9, whereupon, as described before, the position of a predetermined part, e.g., the end of the bucket 1*c*, of the front device 1A at that time is calculated and the excavation area is set based on the calculated value. At the same time, the LED 511 is lit up to inform the operator of that the excavation area is being set.

The up-switch 503*a* and the down-switch 503*b* for the numeral input setting are to set an excavation area by inputting a numeral value and corresponds to the up-key 7*b*1 and the down-key 7*b*2 shown in FIG. 3. When any one of these switches is pushed, a numeral value is increased or reduced in unit of a predetermined amount with 0, for example, as a base, and the input value is indicated on the liquid crystal display screen 520. Also, the input value is applied as a numeral input setting signal to the control unit 9 and the excavation area is set in accordance with the input value. At the same time, the LED 511 is lit up to inform the operator of that the excavation area is being set. Pushing the up-switch 503*a* increases the numeral value and pushing the down-switch 503*b* reduces the numeral value.

The low-speed mode switch 504 is to select whether the area limiting excavation control described in connection with the first embodiment, for example, is to be performed in a speed preference work mode or an accuracy preference work mode. When the mode switch 504 is not pushed and kept turned off, the speed preference work mode is selected and the area limiting excavation control can be efficiently performed by using the detection signals from the pressure sensors 61*a*, 61*b*. When the mode switch 504 is pushed and turned on, the accuracy preference work mode is selected so that the detection signals from the pressure sensors 61*a*, 61*b* are reduced in level and the area limiting excavation control can be precisely performed by using the reduced values.

The display changeover switch 505 is to change over the data indicated on the liquid crystal display screen 520 and corresponds to the setting changeover switch 7*c*1 shown in FIG. 3. When the switch 505 is pushed to select "DEPTH" shown in FIG. 16, the LED 513 is lit up and the depth (or height) of the end position of the bucket 1*c* calculated in the control unit 9 is indicated on the liquid crystal display screen 520. When it is pushed to select "BUCKET ANGLE", the LED 514 is lit up and the angle of the bucket 1*c* calculated in the control unit 9 is indicated on the liquid crystal display screen 520. When it is pushed to select "TRANSVERSE TILT", the LED 515 is lit up and the tilt angle of the body 1B (see FIG. 2) in the transverse direction is indicated on the liquid crystal display screen 520. When it is pushed to select "NUMERAL SETTING", the LED 516 is lit up and the excavation area can be set by inputting a numeral value through the up-switch 503*a* and the down-switch 503*b*.

The 0-setting switch 506 is to set a base for an input value when "DEPTH" and "BUCKET ANGLE" are selected by the display changeover switch 505. When the switch 506 is not pushed and kept turned off, the depth is calculated and indicated with the level of the body 1B on the ground surface as a base (0) for "DEPTH", and the angle is calculated and indicated with the horizontal direction as a base (0) for "BUCKET ANGLE". When the switch 506 is pushed and turned on, the depth is calculated and indicated with the end position of the bucket at that time as a base for "DEPTH", and the angle is calculated and indicated with the direction of the bucket at that time as a base for "BUCKET ANGLE".

The warm-up alarm lamp 517 is to indicate a temperature condition of hydraulic oil (fluid), and is controlled to light up or turn out by the control unit 9 in accordance with a signal from a oil temperature sensor 13. For example, the control unit 9 determines in which one of three oil temperature ranges, i.e., a first oil temperature range, a second oil temperature range higher than the first oil temperature range, and a third oil temperature range higher than the second oil temperature range, the temperature of the hydraulic oil detected by the oil temperature sensor 13 falls. When the temperature of the hydraulic oil is in the third oil temperature range, the warm-up alarm lamp 517 is not lit up. When the temperature of the hydraulic oil is in the second oil temperature range, the warm-up alarm lamp 517 blinks. When the temperature of the hydraulic oil is in the first oil temperature range, the warm-up alarm lamp 517 is lit up continuously and the area limiting control is forcibly ceased. This enables the operator to recognize in which one of the three regions the oil temperature falls currently, and to perform the area limiting excavation control precisely and safely.

With this embodiment thus constructed, the operator can not only easily perform the operation of changing over the control mode and the area setting operation by using the control panel 500, but also obtain necessary information about the position and posture of the bucket. Further, it is possible for the operator to know the current condition of the oil temperature exactly by looking at the warm-up alarm lamp 517 on the control panel 500, and to perform the area limiting excavation control precisely and safely.

A seventh embodiment of the present invention will be described with reference to FIGS. 17 to 20. This embodiment intends to temporarily cancel the front control by using a temporary cancel switch and simply resume the front control after temporary cancellation. In FIGS. 17 to 20, equivalent members or functions to those in FIGS. 1 and 4 are denoted by the same reference numerals.

Figure 17:
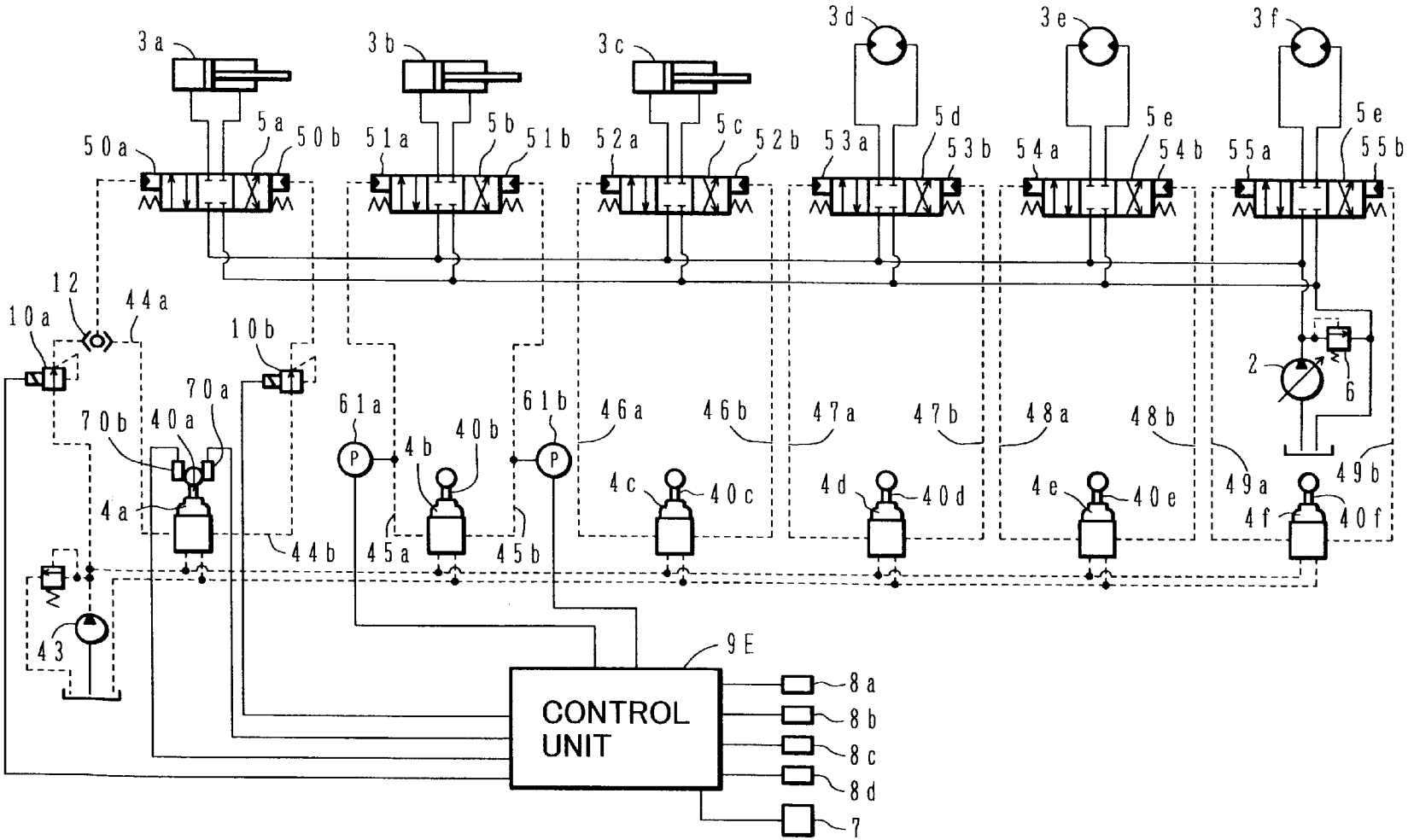
FIG. 17 is a diagram showing a front control system for a construction machine according to a still another (seventh) embodiment of the present invention, along with a hydraulic drive system thereof.

Referring to FIG. 17, a front control system of this embodiment further comprises, in addition to the components of the first embodiment, a second direct setting switch 70*a* for setting by the direct teaching an excavation area where the end of the bucket 1*c* is allowed to move, and a temporary cancel switch 70*b* for instructing temporary cancellation of the area limiting excavation control. Signals from these switches 70*a*, 70*b* are input to a control unit 9E along with the signals explained before in connection with the first embodiment.

Figure 18:
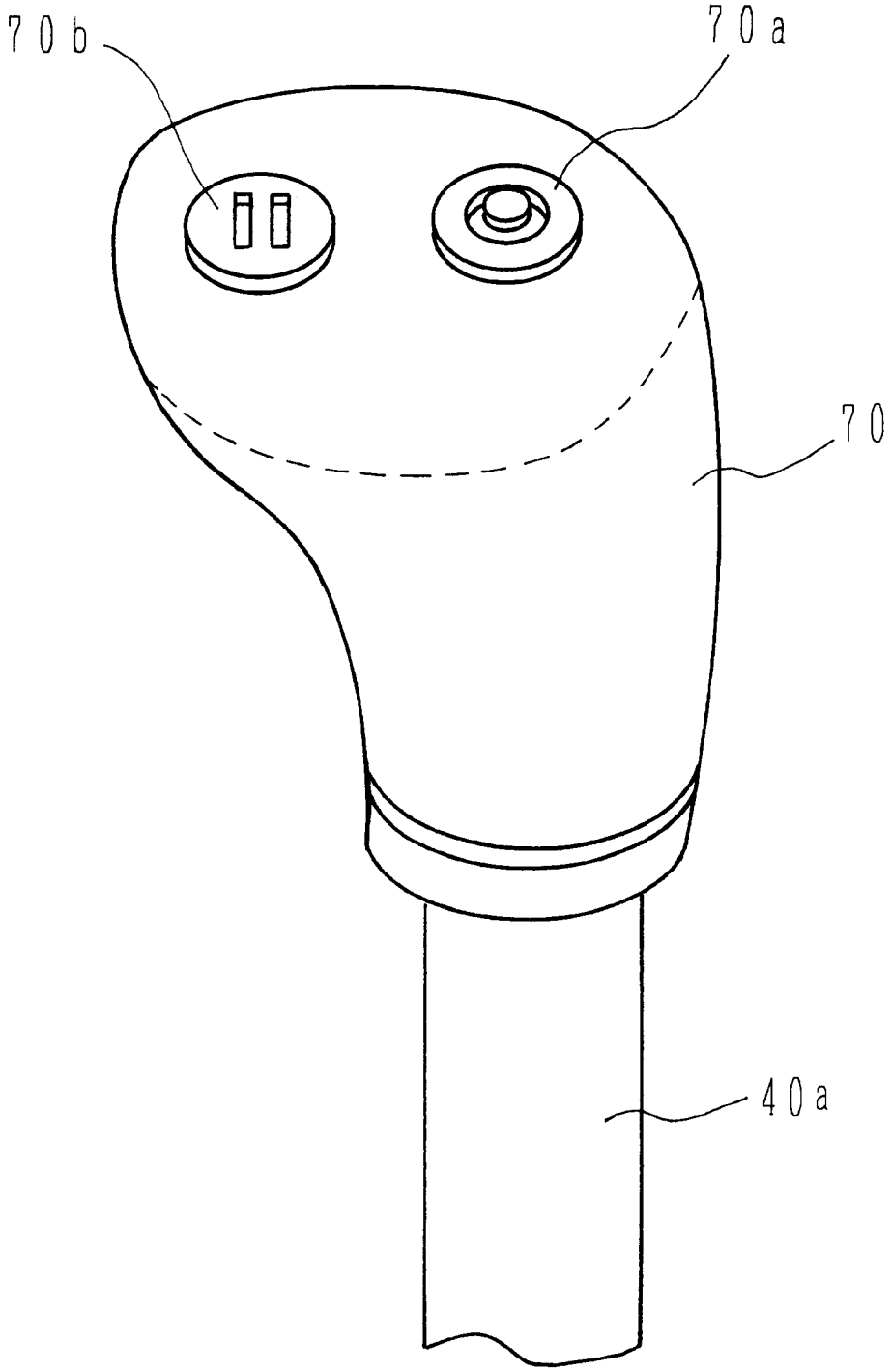
FIG. 18 is a perspective view showing an appearance of a grip portion of a control lever in which a direct setting switch and a temporary cancel switch are provided.

As shown in FIG. 18, the direct setting switch 70*a* and the temporary cancel switch 70*b* are installed on a grip 70 of the control lever 40*a* of the boom control lever unit 4*a*. The direct setting switch 70*a* is a momentarily-operated switch which is turned on only while it is pushed by the operator. When the direct setting switch 70*a* is pushed, an area setting signal is output to the control unit 9E to instruct that the excavation area is to be set or updated by the direct teaching, for example, as with the direct setting switch 7*a* shown in FIG. 3. The temporary cancel switch 70*b* is also a momentarily-operated switch which is turned on only while it is pushed by the operator. While the temporary cancel switch 70*b* is kept pushed, the area limiting excavation control is temporarily cancelled, bringing back the front control system to a normal excavation state. Further, the two switches 70*a*, 70*b* have surface configurations different from each other, allowing the operator to discern the difference between the switches just by touching them by a finger.

In the above, the control lever units 4*a*–4*d* have been denoted by separate reference numerals corresponding to the boom, the arm, the bucket and the upper structure (swing motor). In practice, however, the boom control lever unit 4*a* and the bucket control lever unit 4*c* are constructed as a single control lever unit, and the arm control lever unit 4*b* and the swing control lever unit 4*d* are also constructed as a single control lever unit. Then, by manipulating each control lever of the control lever units two-dimensionally, operation signals (pilot pressures) for the boom and/or the bucket and the arm and/or the upper structure are output.

Figure 19:
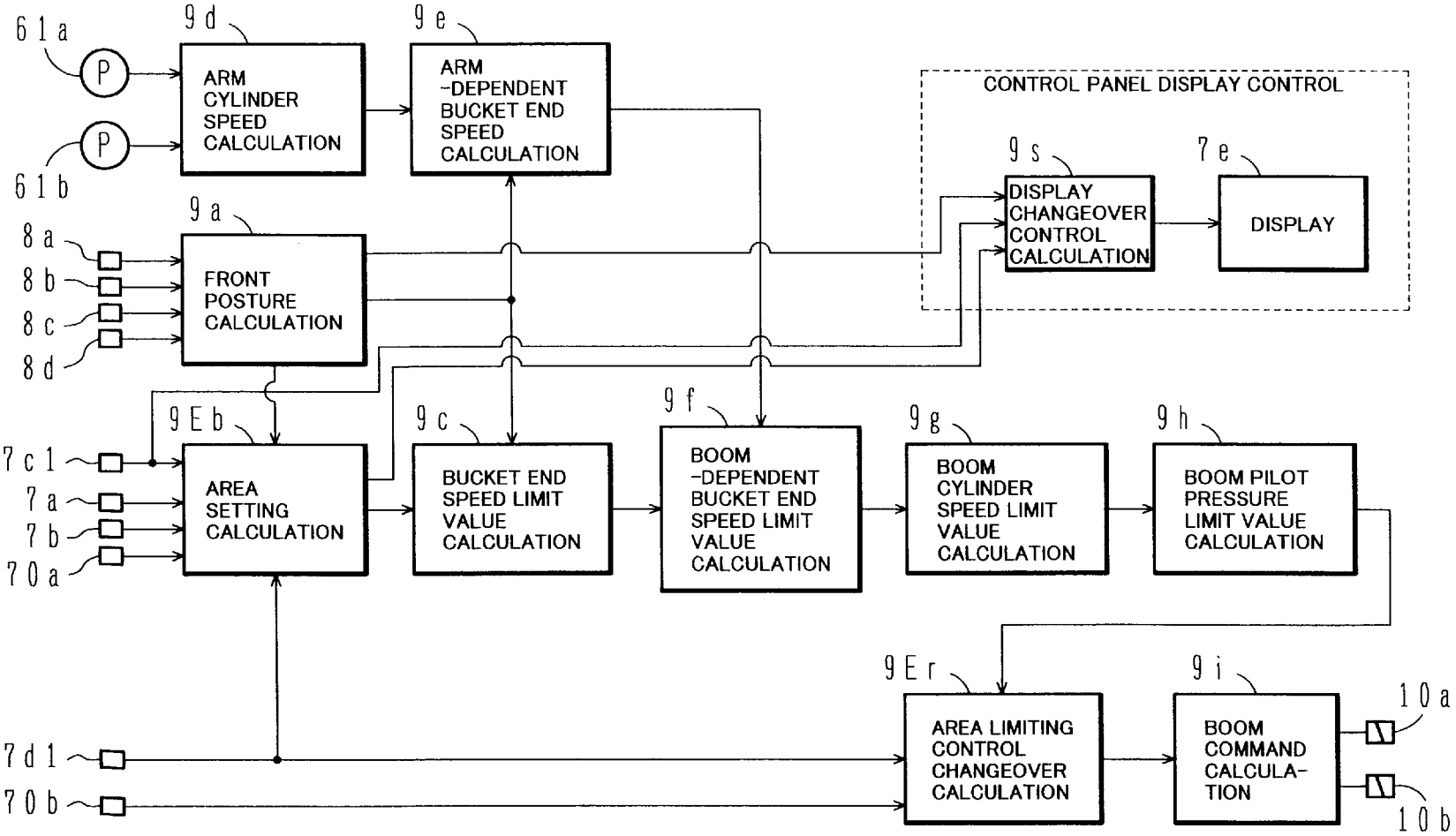
FIG. 19 is a functional block diagram showing control functions of a control unit.

FIG. 19 shows control functions of the control unit 9E. The control functions of the control unit 9E are the same as those of the control unit 9 in the first embodiment except that an area setting calculating portion 9E*b* and an area limiting control changeover calculating portion 9E*r* differ in the points below from the area setting calculating portion 9*b* and the area limiting control changeover calculating portion 9*r* shown in FIG. 4.

The area setting calculating portion 9E*b* executes calculation for setting an excavation area where the end of the bucket 1*c* is allowed to move, in accordance with any one of the direct teaching setting using the direct setting switch 7*a* of the setting device 7 shown in FIG. 3 and the numeral input setting using the numeral input switch 7*b* thereof, and the direct teaching setting using the direct setting switch 70*a* on the control lever 40*a*.

More specifically, in this embodiment, the excavation area can be set by the direct teaching with any of the two switches, i.e., the direct setting switch 7*a* of the setting device 7 and the direct setting switch 70*a* on the control lever 40*a*. The processing steps executed in the area setting calculating portion 9E*b* upon the direct setting switch 70*a* being pushed is the same as those executed upon the direct setting switch 7*a* being pushed. The processing steps are executed following the flowchart shown in FIG. 6, for example, though "7*a*" is replaced by "70*a*". Other than being shown in FIG. 6, the processing steps may be executed following the flowchart shown in FIG. 14 or 15.

The area limiting control changeover calculating portion 9E*r* selectively outputs the value calculated in the calculating portion 9*h* in accordance with turning-on or -off of signals from the area limiting switch 7*d*1 and the temporary cancel switch 70*b*. This process is detailed in a flowchart of FIG. 20.

Figure 20:
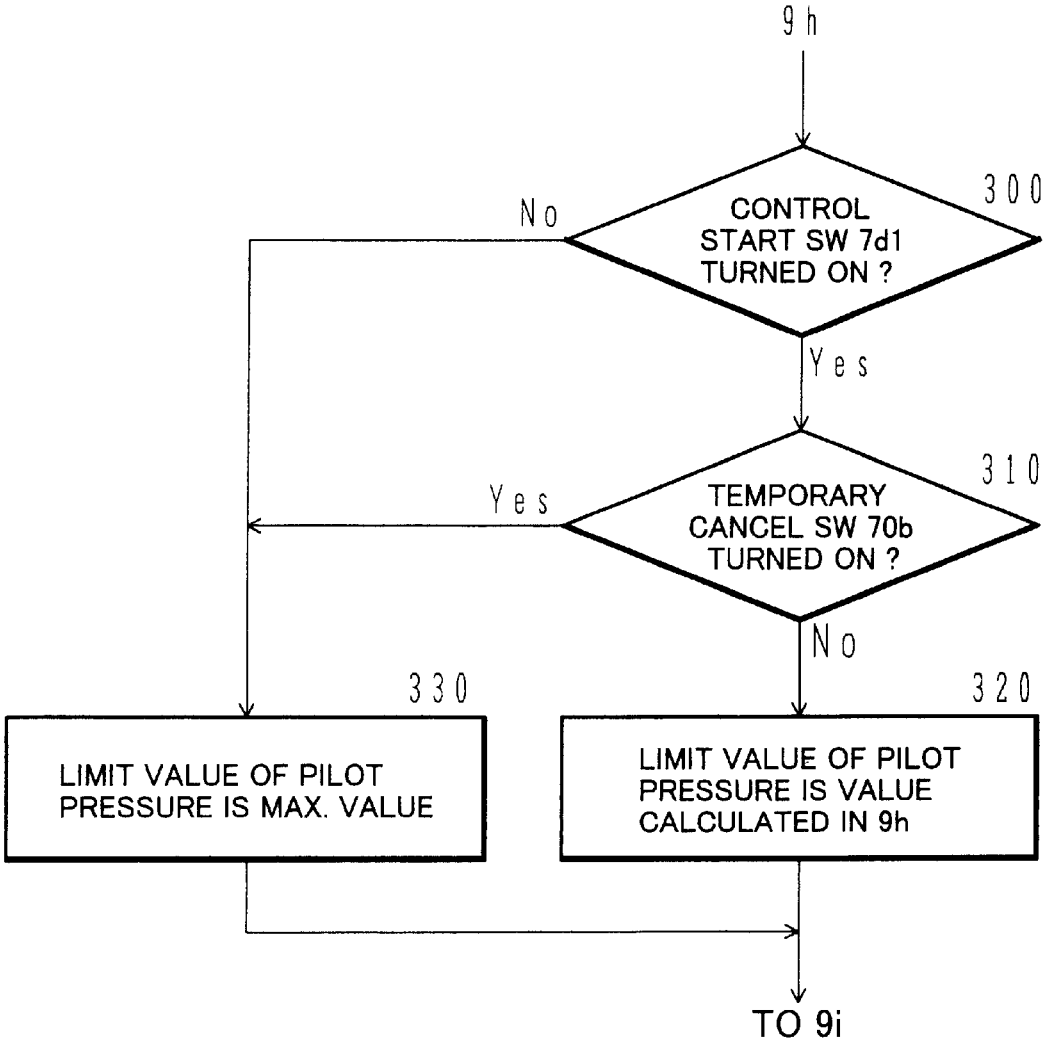
FIG. 20 is a flowchart showing processing steps executed in an area limiting control changeover calculating portion.

Referring to FIG. 20, when the area limiting switch 7*d*1 is turned on (pushed) to instruct the start of the area limiting excavation control and the temporary cancel switch 70*b* is turned off (not pushed) not to instruct temporary cancellation of the control, the value calculated in the calculating portion 9*h* is output directly as the limit value of the boom pilot pressure (step 300→310→320). When the area limiting switch 7*d*1 is turned off (not pushed) not to instruct the start of the area limiting excavation control or when the temporary cancel switch 70*b* is turned on (pushed) to instruct temporary cancellation of the control, a maximum value is output as the limit value of the boom pilot pressure (step 300→320 or 310→330).

In this embodiment thus constructed, the operation performed under the area limiting excavation control with the area limiting switch 7*d*1 turned on and the temporary cancel switch 70*b* turned on is the same as that performed in the first embodiment with the area limiting switch 7*d*1 turned on.

When the operator wants to temporarily cancel the area limiting excavation control during the operation under the area limiting excavation control, the operator turns on (pushes) the temporary cancel switch 70*b* on the grip 70 of the control lever 40*a* of the boom control lever unit 4*a*. Upon the temporary cancel switch 70*b* being pushed, the area limiting control changeover calculating portion 9*r* outputs, as the limit value of the boom pilot pressure, the maximum value rather than the value calculated in the calculating portion 9*h*, and the output value is applied to the boom command calculating portion 9*i* while the switch 70*b* is kept pushed. Therefore, the calculation process executed in the calculating portions 9*a*–9*h* for the area limiting excavation control is made infeasible to cancel the control being executed. After that, when the operator releases his finger from the temporary cancel switch 70*b*, the switch 70*b* is turned off, whereupon the area limiting control changeover calculating portion 9*r* outputs, as the limit value of the boom pilot pressure, the value calculated in the calculating portion 9*h* so that the area limiting excavation control is simply resumed without setting the area limiting excavation control again.

With this embodiment, as described above, since the temporary cancel switch 70*b* is provided, an excavation mode can be easily changed over between the excavation under the normal control and the excavation under the area limiting control. It is thus possible to quickly and smoothly perform digging work requiring a combination of the normal excavation and the excavation under the area limiting control, such as work of burying a water service pipe or the like in the ground by alternately repeating trench digging for which the excavation under the area limiting control is more convenient and pipe installation for which the normal excavation is more convenient.

Also, since the temporary cancel switch 70*b* is provided on the grip 70 of the control lever 40*a* of the boom control lever unit 4*a*, the operator can promptly change over the normal excavation and the excavation under the area limiting control from one to the other without releasing his hand from the control lever.

Further, since not only the temporary cancel switch 70*b* but also the direct setting switch 70*a* are provided on the grip 70 of the control lever 40*a* of the boom control lever unit 4*a*, the operator can also promptly set the excavation area without releasing his hand from the control lever, even when trying to set the excavation area by the direct teaching. This makes the operator not feel troublesome in setting the excavation area.

Moreover, since the direct setting switch 70*a* is provided on the control lever 40*a* of the boom control lever unit 4*a* which instructs the vertical movement of the front device 1A, the operator can push the direct setting switch 70*a* to set the area with his one hand while manipulating the control lever 40*a* to move the boom with the same hand. As a result, the height can be easily adjusted in setting the area and the delicate setting is facilitated.

Additionally, the direct setting switch 70*a* and the temporary cancel switch 70*b* are both installed on the same control lever, but their surface configurations are different from each other. Therefore, the operator can discern the respective functions of the two switches just by touching them without visually confirming the switches, resulting in quicker and smoother operation.

While the direct setting switches 7*a*, 70*a* are provided respectively on the setting device 7 and the control lever 40*a* in the above embodiment, only one of the direct setting switches 7*a*, 70*a* may be provided.

Figure 21:
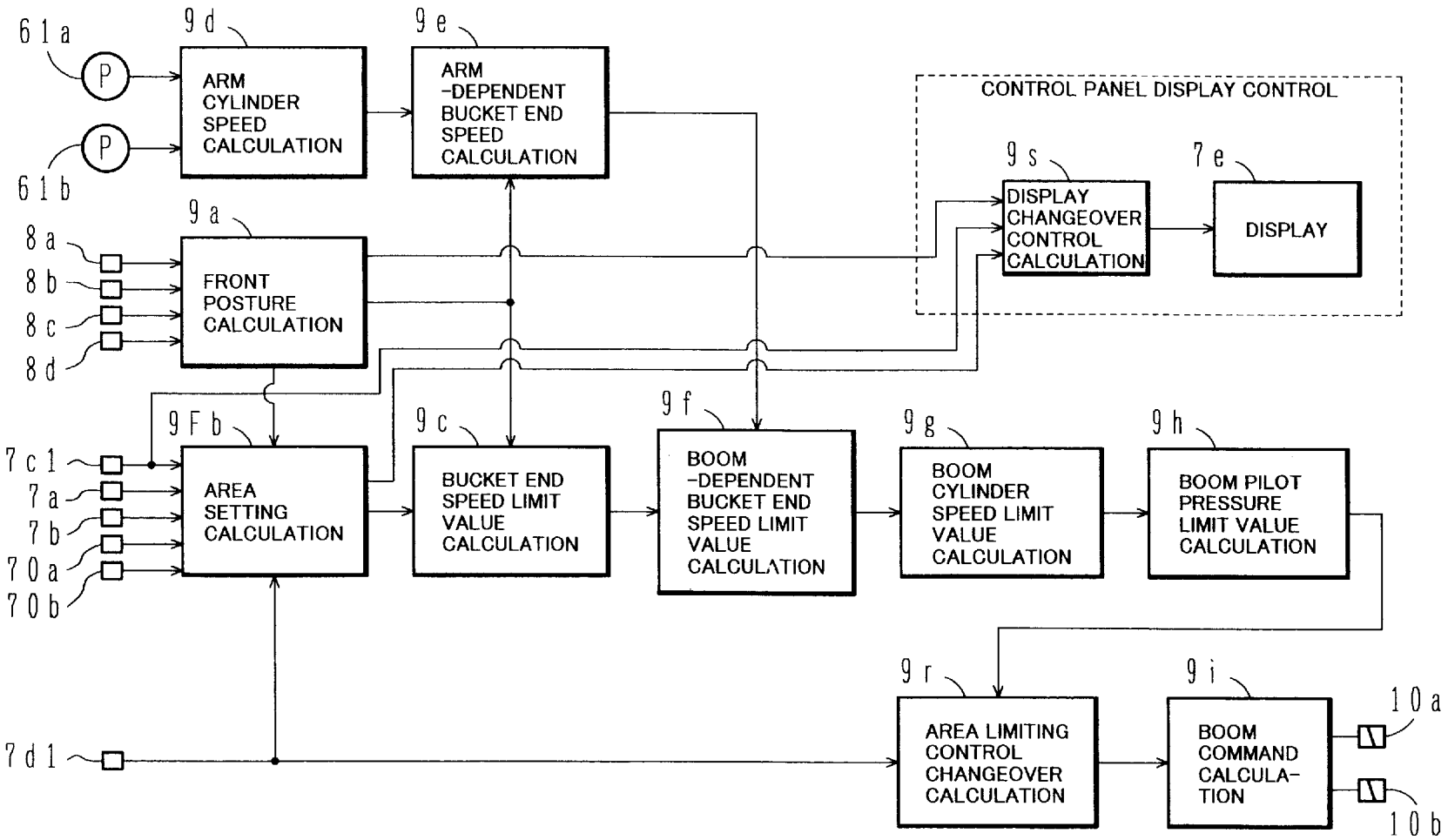
FIG. 21 is a block diagram showing control functions of the control unit for explaining, as an eighth embodiment, a modification of the seventh embodiment of the present invention.
Figure 22:
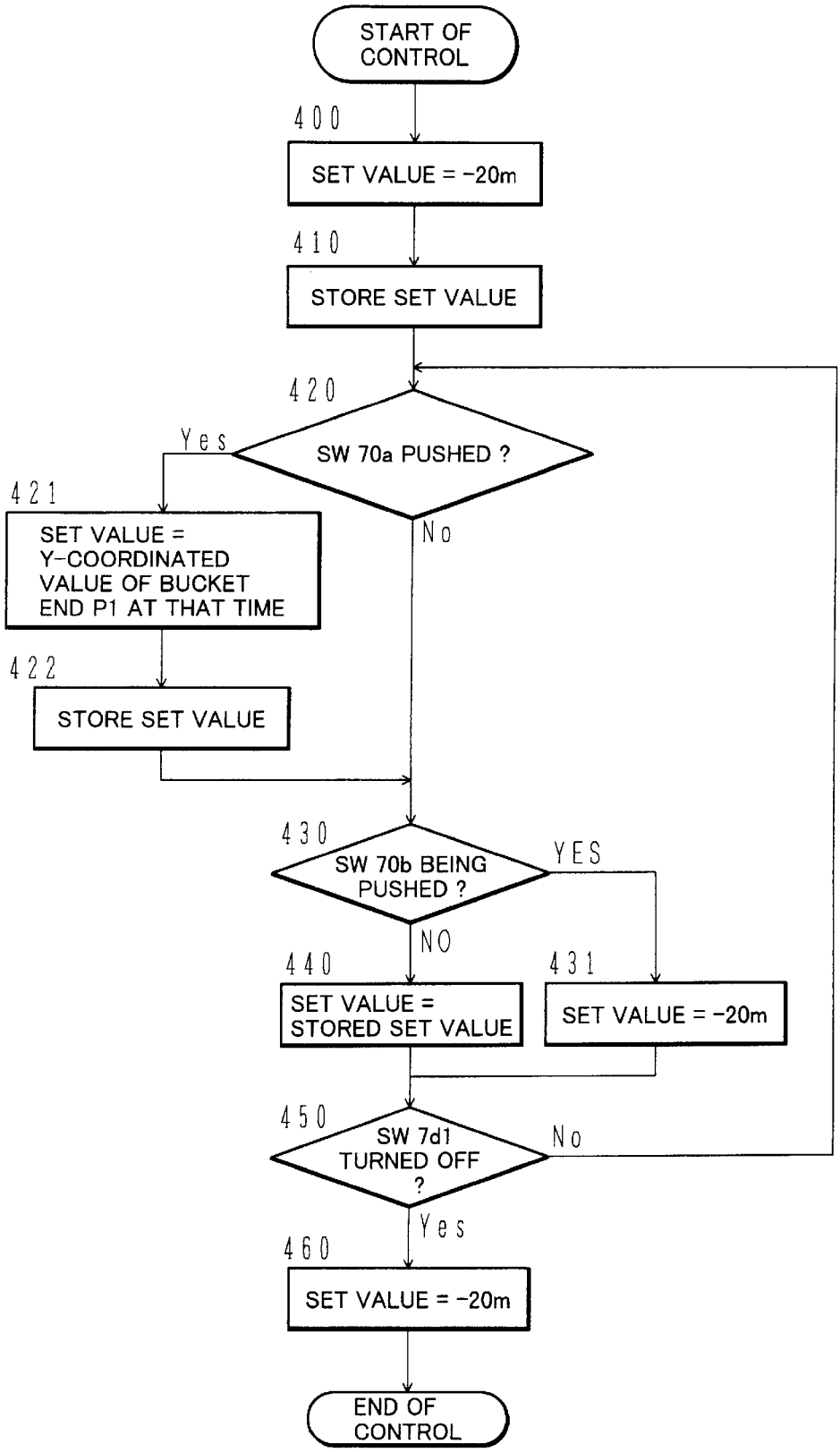
FIG. 22 is a flowchart showing processing steps executed in an area setting calculation portion.

An eighth embodiment of the present invention will be described with reference to FIGS. 21 to 22. In FIGS. 21 to 22, equivalent functions to those in FIGS. 1 and 19 are denoted by the same reference numerals. This embodiment intends to temporarily cancel the front control in a different manner from the seventh embodiment when the temporary cancel switch is pushed.

Referring to FIG. 21, in an area setting calculating portion 9F*b*, the set value of the excavation area is temporarily initialized while the temporary cancel switch 70*b* is kept pushed, and when the temporary cancel switch 70*b* is released, the set value is restored to the value before the temporary cancel switch 70*b* is pushed. This process is detailed in a flowchart of FIG. 22.

Referring to FIG. 22, when the area limiting switch 7*d*1 is turned on (pushed), a value representing a position to which the front device cannot reach, e.g., Y=−20 m as mentioned above, is set as the initial value of the boundary L (depth $h_1$) of the excavation area, and this value is stored (steps 400→410).

Then, the boundary L of the excavation area is set as follows depending on which one of the direct setting switch 70*a* and the temporary cancel switch 70*b* is pushed.

(a) When Direct Setting Switch 70*a* is Pushed

When the operator pushes the direct setting switch 70*a* after moving the end $P_1$ of the bucket 1*c* to a target position, the boundary L of the excavation area is set below by using the Y-coordinate value, $Y=Y_1$, of the bucket end $P_1$ calculated in the front posture calculating portion 9*a* at that time;

set value=Y-coordinate value $Y_1$ and the set value is stored (steps 420→421→422→430→440→450→420).

(b) When Temporary Cancel Switch 70*b* is Being Pushed

When the temporary interrupt switch 70*b* is pushed, the same value as the initial value set upon the area limiting switch 7*d*1 being pushed, i.e., the value (−20 m) representing a position to which the front device cannot reach, is set as the boundary L of the excavation area (steps 430→431→450→420→430). But the set value is not stored.

(c) When Temporary Cancel Switch 70*b* is Released (Turned off)

When the operator releases his finger from the temporary cancel switch 70*b* (to turn off it), the stored value is invoked to set the boundary L of the excavation area below;

set value=stored set value (steps 430→440→450→420→430).

When bringing the area limiting excavation control to an end, the area limiting switch 7*d*1 is pushed again to be turned off (step 450). Then, the boundary L of the excavation area is set to the initial value Y=−20 m again for safety (step 460), followed by ending the front control.

As described above, the area limiting excavation control can also be made essentially infeasible and cancelled for a while by setting the value (−20 m) representing a position to which the front device cannot reach, as the boundary L of the excavation area, and initializing the set value temporarily.

This embodiment can also provide similar advantages as obtainable with the above embodiment.

While typical several embodiments of the present invention have been described hereinabove, the present invention is not limited to those embodiments, but may be modified in various manners. The following are several examples of modification.

(1) The angle sensors for detecting the rotational angles of the front members as means for detecting the status variables relating to the position and posture of the front device 1A. But cylinder strokes may be detected instead of the rotational angles.

(2) The distance D to the bucket end from the boundary L of the set area is employed for the area limiting excavation control. From the viewpoint of implementing the invention in a simpler way, however, the distance to a pin at the arm end from the boundary of the set area may be employed instead. Further, when an area is set for the purpose of preventing interference of the front device with other members and ensuring safety, a predetermined part of the front device may be any other part giving rise to such interference.

(3) While the hydraulic drive system to which the present invention is applied has been described as a closed center system including the flow control valves of closed center type, the invention is also applicable to an open center system including flow control valves of open center type.

(4) While the area limiting excavation control has been described as an example of front control in hydraulic excavators, the invention may also be applied to other types of front control, such as interference preventing control for preventing interference between the front device and a surrounding object.

(5) The temporary cancel switch is in the form of a momentarily-operated switch which is turned on only while it is pushed by the operator, but may be an alternately-operated switch which is kept turned on once pushed, making the front control continue to be cancelled, and is turned off when pushed again, allowing the front control to resume.

(6) While the temporary cancel switch is provided on the boom control lever, it may be provided on the arm control lever.

(7) While the embodiments including the temporary cancel switch have been described as employing the control lever units of hydraulic pilot type, electric control lever units may be employed instead.

What is claimed is:

1. A front control system equipped on a construction machine comprising a multi-articulated front device made up of a plurality of front members rotatable in the vertical direction, a plurality of hydraulic actuators for driving respectively said plurality of front members, and a plurality of hydraulic control valves driven in accordance with respective operation signals input from a plurality of operating means for controlling flow rates of a hydraulic fluid supplied to said plurality of hydraulic actuators, said front control system controlling said front device to be moved in a preset area, wherein said front control system comprises:

first area setting means having a direct setting switch for setting an area where said front device is allowed to move, by direct teaching in response to an instruction from said direct setting switch, second area setting means having a numeral input switch for setting an area where said front device is allowed to move, by inputting a numeral value through said numeral input switch, and setting selection means for selecting one of said first area setting means and said second area setting means.

2. A front control system for a construction machine according to claim 1, further comprising display means for displaying the numeral value input through said numeral input switch of said second area setting means.

3. A front control system for a construction machine according to claim 1, wherein said setting selection means has a setting changeover switch for enabling one of said first area setting means and said second area setting means to be selected when said setting changeover switch is not operated, and enabling the other of said first area setting means and said second area setting means to be selected when said setting changeover switch is operated.

4. A front control system for a construction machine according to claim 3, wherein said setting selection means enables said first area setting means to be selected regardless of whether said setting changeover switch is operated or not, when said direct setting switch of said first area setting means is operated, and enables said second area setting means to be selected when said setting changeover switch is operated.

5. A front control system for a construction machine according to claim 4, further comprising display means, and display changeover means for instructing said display means to display a current position of said front device when said setting changeover switch is not operated, and instructing said display means to display the numeral value input through said numeral input switch of said second area setting means when said setting changeover switch is operated.

6. A front control system for a construction machine according to claim 1, wherein said numeral input switch of said second area setting means comprises a first numeral input key for increasing an input numeral value from a certain base value, and a second numeral input key for reducing an input numeral value from a certain base value.

7. A front control system for a construction machine according to claim 1, wherein said second area setting means previously sets, as an initial value, a value representing a position to which said front device cannot reach, and changes a set numeral value through said numeral input switch with said initial value as a base, thereby setting said area.

8. A front control system for a construction machine according to claim 1, wherein said second area setting means changes a set numeral value through said numeral input switch with the numeral value set by said direct teaching as a base, thereby setting said area.

9. A front control system for a construction machine according to claim 1, further comprising a control selection switch for selecting whether said front device is to be controlled or not, and initializing means for setting, as an initial value of the area to be set, a value representing a position to which said front device cannot reach, each time when said control selection switch is operated for selection of front control.

10. A front control system for a construction machine according to claim 1, further comprising control means for controlling operation of said front device by modifying said operation signal so that said front device is allowed to move within an area set by one of said first area setting means and said second area setting means, a temporary cancel switch, and control cancel means for temporarily cancelling control of said front device performed by said control means when said temporary cancel switch is pushed.

11. A front control system for a construction machine according to claim 10, wherein said temporary cancel switch is provided on a lever grip of one of said plurality of control lever means.

12. A front control system for a construction machine according to claim 10, wherein said direct setting switch and said numeral input switch are provided on a box-type control panel installed in a cab, and said temporary cancel switch is provided on a lever grip of one of said plurality of control lever means.

13. A front control system for a construction machine according to claim 12, wherein said first area setting means further includes another direct setting switch provided on said lever grip for direct setting of the area where said front device is allowed to move.

14. A front control system for a construction machine according to claim 13, wherein said temporary cancel switch and said direct setting switch both provided on said lever grip have surface configurations different from each other.

15. A front control system for a construction machine according to claim 11, wherein said control lever means on which said temporary cancel switch is provided is the control lever means for a boom of a hydraulic excavator.

16. A front control system for a construction machine according to claim 10, wherein said control cancel means comprises means for interrupting modification of the operation signal made by said control means when said temporary cancel switch is pushed.

17. A front control system for a construction machine according to claim 10, wherein said control cancel means comprises means for temporarily changing the set position of a boundary of said area to a value representing a position to which said front control device cannot reach, when said temporary cancel switch is pushed.

18. An area setting method for use in a front control system under which a multi-articulated front device made up of a plurality of front members rotatable in the vertical direction is controlled so that said front device is moved in a preset area, comprising the steps of:

moving said front device to a position as a reference, storing the position by direct teaching, setting a depth by inputting a numeral value with the stored position as a base, and setting an area where said front device is allowed to move, in accordance with a numeral value resulted from said depth setting.

19. A control panel of a front control system equipped on a construction machine comprising a multi-articulated front device made up of a plurality of front members rotatable in the vertical direction, a plurality of hydraulic control valves driven in accordance with respective operation signals input from a plurality of operating means for controlling flow rates of a hydraulic fluid supplied to said plurality of hydraulic actuators, said front control system controlling said front device to be moved in a preset area, wherein said control panel comprises:

a direct setting switch for instructing by direct teaching setting of an area where said front device is allowed to move, a numeral input switch for instructing by input of a numeral value setting of an area where said front device is allowed to move, and a setting changeover switch for selecting one of the setting instructions from said direct setting switch and said numeral input switch.

20. A control panel of a front control system for a construction machine according to claim 19, further comprising display means for displaying the numeral value input through said numeral input switch.

21. A control panel of a front control system for a construction machine according to claim 19, further comprising display means for displaying a current position of said front device when said setting changeover switch is not operated, and displaying the numeral value input through said numeral input switch when said setting changeover switch is operated.

22. A control panel of a front control system for a construction machine according to claim 19, wherein said numeral input switch comprises a first numeral input key for increasing an input numeral value from a certain base value, and a second numeral input key for reducing an input numeral value from a certain base value.

23. A control panel of a front control system for a construction machine according to claim 19, further comprising a control selection switch for selecting whether said front device is to be controlled or not, whereby selection of the control of said front device by said control selection switch enables said direct setting switch and said numeral input switch to instruct the setting.

24. A front control system for a construction machine according to claim 12, wherein said control lever means on which said temporary cancel switch is provided is the control lever means for a boom of a hydraulic excavator.

* * * * *